US011839278B2

(12) United States Patent
Larson et al.

(10) Patent No.: US 11,839,278 B2
(45) Date of Patent: Dec. 12, 2023

(54) CLOSURE SYSTEMS AND INSULATING DEVICES HAVING CLOSURE SYSTEMS

(71) Applicant: YETI Coolers, LLC, Austin, TX (US)

(72) Inventors: Erik Steven Larson, Austin, TX (US); Derek G. Sullivan, Austin, TX (US); Karl Fritzsche, Seattle, WA (US); Christopher M. Keller, Austin, TX (US); Alex Baires, Austin, TX (US); Scott Barbieri, Austin, TX (US); Bryan Seon, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

(21) Appl. No.: 17/481,949

(22) Filed: Sep. 22, 2021

(65) Prior Publication Data

US 2022/0015516 A1 Jan. 20, 2022

Related U.S. Application Data

(62) Division of application No. 15/773,107, filed as application No. PCT/US2016/060135 on Nov. 2, 2016, now Pat. No. 11,266,215.

(Continued)

(51) Int. Cl.

*A44B 19/32* (2006.01)
*A45C 11/20* (2006.01)

(Continued)

(52) U.S. Cl.

CPC ..... *A45C 11/20* (2013.01); *A44B 19/32* (2013.01); *A45C 13/008* (2013.01); *A45C 13/103* (2013.01)

(58) Field of Classification Search

CPC ..... A45C 11/20; A45C 13/008; A45C 13/103; A44B 19/32

See application file for complete search history.

(56) References Cited

U.S. PATENT DOCUMENTS 210,994 A 12/1878 Carnagy
430,944 A 6/1890 Hammerl (Continued)

FOREIGN PATENT DOCUMENTS

AU 201614228 S 8/2016
AU 201614229 S 8/2016

(Continued)

OTHER PUBLICATIONS

Exhibits C-8, D-6, E-6, and F-6 "Filson Rugged Twill Bucket Bag", U.S. District Court Western District of Texas, "Defendants RTIC Outdoors, LLC's and Corporate Support & Fulfillment, LLC's Invalidity Contentions", *YETI Coolers, LLC* v. *RTIC Outdoors, LLC*, Case No. 1:21-cv-00214, Jan. 17, 2022, pp. 486-491, 568-582, 649-661, and 722-735.

(Continued)

*Primary Examiner* — Jason W San

(74) *Attorney, Agent, or Firm* — Banner & Witcoff, Ltd.

(57) ABSTRACT

A closure having a first flange with first engagement mechanism and a second with a second engagement mechanism disposed between the first end and the second end. The first engagement mechanism configured to engage the second engagement mechanism. A slider configured to selectively engage the first engagement mechanism and the second mechanism when moved in a first direction and disengage the first engagement mechanism from the second engagement mechanism when moved in a second direction. The closure is substantially watertight in the closed position.

21 Claims, 15 Drawing Sheets

Related U.S. Application Data

(60) Provisional application No. 62/249,711, filed on Nov. 2, 2015.

(51) Int. Cl.
*A45C 13/00* (2006.01)
*A45C 13/10* (2006.01)

(56) References Cited

U.S. PATENT DOCUMENTS 1,512,549 A 10/1924 Labadie et al.
1,587,655 A 6/1926 Kidwell
1,895,278 A 1/1933 Crawford
1,949,677 A 3/1934 Crawford
2,119,621 A 6/1938 Ferrone
2,241,612 A 5/1941 Norris
2,253,598 A 8/1941 Africa
2,289,254 A 7/1942 Eagles
2,429,538 A 10/1947 Wood
2,522,381 A 9/1950 Kramer
2,556,066 A 6/1951 Cline
2,570,300 A 10/1951 Acton
2,575,191 A 11/1951 Seipp
2,575,893 A 11/1951 Seaman
2,623,566 A 12/1952 Renaker
2,633,223 A 3/1953 Zeamer
2,651,485 A 9/1953 Schutz
2,661,785 A 12/1953 Daust
2,685,385 A 8/1954 Kuss
2,808,093 A 10/1957 Gilman
2,883,041 A 4/1959 Pfeifer et al.
2,954,891 A 10/1960 Imber
2,960,136 A 11/1960 Ziff
3,031,121 A 4/1962 Chase
3,035,733 A 5/1962 Knapp
3,066,846 A 12/1962 Domigan
3,157,303 A 11/1964 Siegel
3,203,517 A 8/1965 Stein
3,292,277 A 12/1966 Teschon
3,454,197 A 7/1969 Thompson
3,455,359 A 7/1969 Schweizer
3,743,522 A 7/1973 Nagasawa et al.
3,801,425 A 4/1974 Cook
3,814,288 A 6/1974 Westrich
3,834,044 A 9/1974 McAusland et al.
3,905,511 A 9/1975 Groendal
4,024,731 A 5/1977 Branscum
4,125,212 A 11/1978 Courchesne
4,127,155 A 11/1978 Hydorn
4,143,695 A 3/1979 Hoehn
4,194,627 A 3/1980 Christensen
4,196,817 A 4/1980 Moser
4,197,890 A 4/1980 Simko
4,210,186 A 7/1980 Belenson
4,211,091 A 7/1980 Campbell
4,211,267 A 7/1980 Skovgaard
4,248,366 A 2/1981 Christiansen
D265,948 S 8/1982 Stark
4,344,303 A 8/1982 Kelly, Jr.
4,372,453 A 2/1983 Branscum
4,375,828 A 3/1983 Biddison
D268,879 S 5/1983 Outcalt
4,399,668 A 8/1983 Williamson
4,468,933 A 9/1984 Christopher
4,484,682 A 11/1984 Crow
4,513,895 A 4/1985 Leslie
4,515,421 A 5/1985 Steffes
4,521,910 A 6/1985 Keppel et al.
4,524,493 A * 6/1985 Inamura ..... A44B 19/32 24/389
4,537,313 A 8/1985 Workman
4,541,540 A 9/1985 Gretz et al.
D281,122 S 10/1985 Bomes et al.
D281,546 S 12/1985 Bradshaw
D281,646 S 12/1985 Bomes et al.
D282,602 S 2/1986 Allen
4,571,338 A 2/1986 Okonogi et al.
4,595,101 A 6/1986 Rivera
4,596,370 A 6/1986 Adkins
D284,620 S 7/1986 Calton
4,598,746 A 7/1986 Rabinowitz
4,637,063 A 1/1987 Sullivan et al.
D289,128 S 4/1987 Bradshaw
4,673,117 A 6/1987 Calton
4,679,242 A 7/1987 Brockhaus
4,708,254 A 11/1987 Byrns
4,746,028 A 5/1988 Bagg
4,759,077 A 7/1988 Leslie
4,765,476 A 8/1988 Lee
4,796,785 A 1/1989 Merritt
4,796,937 A 1/1989 Andrea
4,802,344 A 2/1989 Livingston et al.
4,802,602 A 2/1989 Evans et al.
4,805,776 A 2/1989 Namgyal et al.
4,812,054 A 3/1989 Kirkendall
4,815,999 A 3/1989 Ayon et al.
4,817,769 A 4/1989 Saliba
4,825,514 A * 5/1989 Akeno ..... A44B 19/36 24/387
4,826,060 A 5/1989 Hollingsworth
4,829,603 A * 5/1989 Schnoor ..... A44B 19/386 2/84
4,841,603 A * 6/1989 Ragni ..... B65D 33/255 24/584.1
4,858,444 A 8/1989 Scott
4,867,214 A 9/1989 Fuller
4,871,069 A 10/1989 Guimont
4,886,183 A 12/1989 Fleming
4,941,603 A 7/1990 Creamer et al.
4,961,522 A 10/1990 Weber
4,966,279 A 10/1990 Pearcy
4,984,906 A 1/1991 Little
4,986,089 A 1/1991 Raab
4,989,418 A 2/1991 Hewlett
5,004,091 A 4/1991 Natho et al.
5,005,679 A 4/1991 Hjelle
5,035,029 A * 7/1991 Horita ..... A44B 19/10 24/396
5,042,664 A 8/1991 Shyr et al.
5,048,734 A 9/1991 Long
5,062,557 A 11/1991 Mahvi et al.
5,095,718 A 3/1992 Ormond et al.
D328,550 S 8/1992 Mogil et al.
5,143,188 A 9/1992 Robinet
5,190,376 A 3/1993 Book
5,216,900 A 6/1993 Jones
5,221,016 A 6/1993 Karpal
5,237,838 A 8/1993 Merritt-Munson
5,244,136 A 9/1993 Collaso
D339,979 S 10/1993 Wehrley
D340,387 S 10/1993 Melk
D340,621 S 10/1993 Melk
5,253,395 A * 10/1993 Yano ..... A44B 19/265 24/387
D340,840 S 11/1993 Melk
5,269,368 A 12/1993 Schneider et al.
D343,992 S 2/1994 Melk
5,295,365 A 3/1994 Redford
5,297,870 A 3/1994 Weldon
5,313,807 A 5/1994 Owen
D347,971 S 6/1994 Krugman
5,325,991 A 7/1994 Williams
D349,428 S 8/1994 Krugman
D351,533 S 10/1994 Lynam, Jr.
5,354,131 A 10/1994 Mogil
5,355,684 A 10/1994 Guice
5,398,848 A 3/1995 Padamsee
5,400,610 A 3/1995 Macedo
5,403,095 A 4/1995 Melk
5,421,172 A 6/1995 Jones
5,447,764 A 9/1995 Langford
5,472,279 A 12/1995 Lin
5,490,396 A 2/1996 Morris
5,509,279 A 4/1996 Brown et al.

(56) References Cited

U.S. PATENT DOCUMENTS 5,509,734 A * 4/1996 Ausnit ..... B65D 33/255 383/63
D370,599 S 6/1996 Christopher et al.
D371,051 S 6/1996 Melk
D371,052 S 6/1996 Melk
5,529,217 A 6/1996 Siegel
D373,515 S 9/1996 Melk
5,553,759 A 9/1996 McMaster et al.
D374,979 S 10/1996 Roberson et al.
5,562,228 A 10/1996 Ericson
5,564,568 A 10/1996 Rankin, Sr.
5,569,401 A 10/1996 Gilliland et al.
5,595,320 A 1/1997 Aghassipour
5,620,069 A 4/1997 Hurwitz
D382,771 S 8/1997 Mogil
D382,772 S 8/1997 Mogil
D383,360 S 9/1997 Melk
5,680,944 A 10/1997 Rueter
5,680,958 A 10/1997 Mann et al.
D386,310 S 11/1997 Smith
5,687,874 A 11/1997 Omori et al.
D387,249 S 12/1997 Mogil
D387,626 S 12/1997 Melk
5,706,969 A 1/1998 Yamada et al.
5,732,867 A 3/1998 Perkins et al.
D394,553 S 5/1998 Lin
D395,555 S 6/1998 Ursitti
5,758,513 A 6/1998 Smith
5,779,089 A 7/1998 West
D397,273 S 8/1998 Collie
5,816,709 A 10/1998 Demus
D401,063 S 11/1998 Yamamoto et al.
5,842,571 A 12/1998 Rausch
5,845,514 A 12/1998 Clarke et al.
5,848,734 A 12/1998 Melk
5,857,778 A 1/1999 Ells
D409,375 S 5/1999 Santoro et al.
D409,376 S 5/1999 Golenz et al.
5,904,230 A 5/1999 Peterson
5,909,821 A 6/1999 Guridi
5,913,448 A 6/1999 Mann et al.
5,915,580 A 6/1999 Melk
5,931,583 A 8/1999 Collie
D414,379 S 9/1999 Haberkorn
5,954,253 A 9/1999 Swetish
5,955,948 A 9/1999 Howell
5,964,384 A 10/1999 Young
5,988,468 A 11/1999 Murdoch et al.
5,988,879 A 11/1999 Bredderman et al.
6,019,245 A 2/2000 Foster et al.
6,027,249 A 2/2000 Bielinski
6,029,847 A 2/2000 Mahoney, Jr. et al.
6,048,099 A 4/2000 Muffett et al.
D424,417 S 5/2000 Axelsson
6,059,140 A 5/2000 Hicks
6,065,873 A 5/2000 Fowler
6,068,402 A 5/2000 Freese et al.
6,070,718 A 6/2000 Drabwell
6,073,796 A 6/2000 Mogil
6,082,589 A 7/2000 Ash et al.
6,082,896 A 7/2000 Pulli
6,089,038 A 7/2000 Tattam
6,092,266 A 7/2000 Lee
6,092,661 A 7/2000 Mogil
6,105,214 A * 8/2000 Press ..... B32B 27/12 24/384
6,113,268 A 9/2000 Thompson
6,116,045 A 9/2000 Hodosh et al.
6,128,915 A 10/2000 Wagner
6,129,254 A 10/2000 Yu
6,139,188 A 10/2000 Marzano
6,145,715 A 11/2000 Slonim
6,149,305 A 11/2000 Fier
D437,110 S 2/2001 Ivarson et al.
6,193,034 B1 2/2001 Fournier
6,209,343 B1 4/2001 Owen
6,220,473 B1 4/2001 Lehman et al.
6,234,677 B1 * 5/2001 Mogil ..... A45C 13/02 383/110
6,237,776 B1 5/2001 Mogil
6,244,458 B1 6/2001 Frysinger et al.
6,247,328 B1 6/2001 Mogil
6,253,570 B1 7/2001 Lustig
6,276,579 B1 8/2001 DeLoach
D447,632 S 9/2001 Gisser
D447,667 S 9/2001 Schneider et al.
6,286,709 B1 9/2001 Hudson
6,296,134 B1 10/2001 Cardinale
6,296,165 B1 10/2001 Mears
6,298,993 B1 10/2001 Kalozdi
6,336,342 B1 1/2002 Zeddies
6,336,577 B1 1/2002 Harris et al.
6,347,706 B1 2/2002 D'Ambrosio
6,353,215 B1 3/2002 Revels et al.
D455,934 S 4/2002 Culp et al.
6,363,739 B1 4/2002 Hodosh et al.
D457,307 S 5/2002 Pukall et al.
6,394,325 B1 5/2002 Taylor
6,409,066 B1 6/2002 Schneider et al.
6,422,032 B1 7/2002 Greene
6,427,294 B1 * 8/2002 Shibaike ..... A44B 19/32 24/381
6,439,389 B1 8/2002 Mogil
D464,235 S 10/2002 Jeong
D465,134 S 11/2002 Joss
6,481,239 B2 11/2002 Hodosh et al.
D466,291 S 12/2002 Ng
6,495,194 B2 12/2002 Sato et al.
6,505,479 B2 1/2003 Defelice et al.
6,511,695 B1 1/2003 Paquin et al.
6,513,661 B1 2/2003 Mogil
D472,431 S 4/2003 Spence, Jr.
6,554,155 B1 4/2003 Beggins
D474,649 S 5/2003 Spence, Jr.
6,582,124 B2 6/2003 Mogil
D476,481 S 7/2003 Gilbert
6,595,687 B2 7/2003 Godshaw et al.
D478,782 S 8/2003 Li
6,604,649 B1 8/2003 Campi
6,605,311 B2 8/2003 Villagran et al.
6,619,447 B1 9/2003 Garcia, III et al.
6,626,342 B1 9/2003 Gleason
6,629,430 B2 10/2003 Mills et al.
D482,241 S 11/2003 Tyler
6,640,856 B1 11/2003 Tucker
6,652,933 B2 11/2003 Hall
6,655,543 B2 12/2003 Beuke
D485,131 S 1/2004 Lanman et al.
D485,732 S 1/2004 Lanman et al.
D486,038 S 2/2004 Lanman et al.
6,688,470 B2 2/2004 Dege et al.
6,729,758 B1 5/2004 Carter
D491,354 S 6/2004 Chapelier
D492,160 S 6/2004 Lanman et al.
D497,518 S 10/2004 Bellofatto, Jr. et al.
6,799,693 B2 10/2004 Meza
D498,924 S 11/2004 Karl
D501,600 S 2/2005 Guyon
D502,599 S 3/2005 Cabana et al.
D503,279 S 3/2005 Smith
6,874,356 B2 4/2005 Komfeldt et al.
D506,645 S 6/2005 Bellofatto, Jr. et al.
6,925,834 B2 8/2005 Fuchs
D512,274 S 12/2005 Cabey
D515,362 S 2/2006 Chan
D516,099 S 2/2006 Maruyama
D516,870 S 3/2006 Martinez et al.
D517,801 S 3/2006 Woo
D520,306 S 5/2006 Peterson
D522,811 S 6/2006 Martinez et al.
D523,243 S 6/2006 Nashmy
D527,226 S 8/2006 Maldonado
D530,089 S 10/2006 Silverman
7,153,025 B1 12/2006 Jackson et al.

(56) References Cited

U.S. PATENT DOCUMENTS

D534,352 S 1/2007 Delafontaine
D534,771 S 1/2007 Zorn
D535,099 S 1/2007 Johansson et al.
D535,820 S 1/2007 Kamiya
7,160,028 B1 1/2007 Linday
7,162,890 B2 1/2007 Mogil et al.
7,172,101 B2 2/2007 Find
D539,033 S 3/2007 Cassegrain
D540,037 S 4/2007 Newson
7,201,285 B2 4/2007 Beggins
7,207,716 B2 4/2007 Buchanan et al.
7,219,814 B2 5/2007 Lown et al.
7,240,513 B1 7/2007 Conforti
D547,941 S 8/2007 Lucena
D548,459 S 8/2007 Harvey
D550,448 S 9/2007 Boje et al.
7,264,134 B2 9/2007 Tulp
D557,667 S 12/2007 Kawamura et al.
7,302,810 B2 12/2007 McCrory
D560,102 S 1/2008 Sumter
7,313,927 B2 1/2008 Barker
7,344,028 B2 3/2008 Hanson
D566,484 S 4/2008 George
7,353,952 B2 4/2008 Swartz et al.
D570,603 S 6/2008 Wu et al.
D573,422 S 7/2008 Tagliati et al.
D574,667 S 8/2008 Grabijas, III et al.
D578,401 S 10/2008 Perry et al.
D582,151 S 12/2008 Gonzalez
D583,152 S 12/2008 Keeney
7,481,065 B2 1/2009 Krieger
D587,010 S 2/2009 Deck
7,527,430 B2 5/2009 Suskind
D598,194 S 8/2009 Turvey et al.
D599,550 S 9/2009 Turvey et al.
7,581,886 B2 9/2009 Nitti
7,597,478 B2 10/2009 Pruchnicki et al.
D603,606 S 11/2009 Wang
7,634,919 B2 12/2009 Bernhard, Jr. et al.
D607,697 S 1/2010 Whitlock et al.
D608,095 S 1/2010 Turvey et al.
D608,096 S 1/2010 Noble
D608,159 S 1/2010 Whitlock et al.
D610,795 S 3/2010 Dejadon
D611,706 S 3/2010 Angles et al.
D612,605 S 3/2010 Turvey et al.
7,669,436 B2 3/2010 Mogil et al.
7,677,406 B2 3/2010 Maxson
7,682,080 B2 3/2010 Mogil
D617,560 S 6/2010 Wu
7,730,739 B2 6/2010 Fuchs
D618,966 S 7/2010 Koehler et al.
D619,423 S 7/2010 Koehler et al.
D619,854 S 7/2010 Koehler et al.
D619,855 S 7/2010 Koehler et al.
7,757,878 B2 7/2010 Mogil et al.
7,762,294 B2 7/2010 Wang
D620,707 S 8/2010 Mogil
D620,708 S 8/2010 Sanz
D621,609 S 8/2010 Hasty
7,775,388 B2 8/2010 Murrer, III
7,784,759 B2 8/2010 Farrell
7,791,003 B2 9/2010 Lockhart et al.
7,811,620 B2 10/2010 Merrill et al.
7,815,069 B1 10/2010 Bellofatto et al.
D626,329 S 11/2010 Chapelier
D627,199 S 11/2010 Pruchnicki
7,841,207 B2 11/2010 Mogil et al.
D629,612 S 12/2010 Weldon
D630,844 S 1/2011 Wang et al.
7,874,177 B2 1/2011 Azamy
7,886,936 B2 2/2011 Helline
7,900,816 B2 3/2011 Kastanek et al.
D638,220 S 5/2011 Chu et al.
D642,870 S 8/2011 Whitlock et al.
7,988,006 B2 8/2011 Mogil et al.
D645,662 S 9/2011 Perez
8,016,090 B2 9/2011 McCoy et al.
8,043,004 B2 10/2011 Mogil
D648,532 S 11/2011 Sosnovsky
8,061,159 B2 11/2011 Mogil et al.
D650,169 S 12/2011 Klifa
8,079,451 B2 12/2011 Rothschild et al.
8,096,442 B2 1/2012 Ramundi
D659,998 S 5/2012 Austin
8,176,749 B2 5/2012 LaMere et al.
D662,316 S 6/2012 Nitkin
8,191,747 B2 6/2012 Pruchnicki
D664,261 S 7/2012 Kravitz et al.
8,209,995 B2 7/2012 Kieling et al.
D666,896 S 9/2012 Pinholster, Jr. et al.
D667,043 S 9/2012 Couch, III
8,281,950 B2 10/2012 Potts et al.
8,292,119 B2 10/2012 Kenneally
8,302,749 B2 11/2012 Melmon et al.
8,327,659 B2 12/2012 Winkler et al.
D673,363 S 1/2013 Crandall
D673,772 S 1/2013 Munson et al.
D674,246 S 1/2013 Scott et al.
D674,664 S 1/2013 Collie
8,424,319 B2 4/2013 Whewell, Jr.
8,424,713 B2 4/2013 Bolland
8,430,284 B2 4/2013 Broadbent et al.
D682,635 S 5/2013 Boroski
D684,767 S 6/2013 Gerbi
8,453,899 B1 6/2013 Calkin
D686,412 S 7/2013 Guichot
8,474,640 B2 7/2013 Armstrong
8,516,848 B2 8/2013 White et al.
D690,100 S 9/2013 Alfaks
8,544,678 B1 10/2013 Hughes
8,573,002 B2 11/2013 Ledoux et al.
D695,568 S 12/2013 Hayes
8,622,235 B2 1/2014 Suchecki
D699,940 S 2/2014 Robert
D699,941 S 2/2014 Robert
8,646,970 B2 2/2014 Mogil
D701,041 S 3/2014 Burnett
D703,946 S 5/2014 Tweedie
8,720,681 B1 5/2014 Hancock et al.
8,720,739 B2 5/2014 Bollis
8,777,045 B2 7/2014 Mitchell et al.
D710,085 S 8/2014 Szewczyk
D711,096 S 8/2014 Hanna
D711,100 S 8/2014 Dingizian
D712,555 S 9/2014 Berg
8,827,109 B1 9/2014 Sheehan
8,844,756 B2 9/2014 Beyburg
D715,544 S 10/2014 Levine
8,857,654 B2 10/2014 Mogil et al.
D717,041 S 11/2014 Pulliam
D718,053 S 11/2014 McFreen
8,875,964 B1 11/2014 Vanderberg
8,893,940 B2 11/2014 Green et al.
D718,931 S 12/2014 Brundl
D719,303 S 12/2014 Anderson
8,899,071 B2 12/2014 Mogil et al.
D723,804 S 3/2015 Coleman
D725,908 S 4/2015 Zwetzig
D728,942 S 5/2015 Byham
D732,295 S 6/2015 Aafjes
D732,348 S 6/2015 Seiders et al.
D732,349 S 6/2015 Seiders et al.
D732,350 S 6/2015 Seiders et al.
D732,899 S 6/2015 Seiders et al.
D734,643 S 7/2015 Boroski
D734,992 S 7/2015 Boroski
9,084,463 B2 7/2015 Merrill
D738,108 S 9/2015 Adler et al.
D739,654 S 9/2015 Brouard
9,138,033 B2 * 9/2015 Kojima ..... A44B 19/32
9,139,352 B2 * 9/2015 Seiders ..... A45C 3/00
9,146,051 B2 9/2015 Kamin et al.
D743,699 S 11/2015 Wieden

(56) References Cited

U.S. PATENT DOCUMENTS

D744,786 S 12/2015 Bagwell
D747,104 S 1/2016 Ford
9,226,558 B2 1/2016 Armstrong
D749,653 S 2/2016 Carnes
D750,140 S 2/2016 Cross
9,254,022 B2 2/2016 Meldeau et al.
9,254,023 B2 2/2016 Su et al.
9,265,318 B1 2/2016 Williams et al.
D752,347 S 3/2016 Seiders et al.
9,271,553 B2 3/2016 Ponx
9,272,475 B2 3/2016 Ranade et al.
9,290,313 B2 3/2016 De Lesseux et al.
D752,860 S 4/2016 Barilaro et al.
9,307,814 B2 4/2016 Pulliam
9,314,069 B2 * 4/2016 Takazawa ..... A44B 19/32
D756,109 S 5/2016 Hayashi
D756,638 S 5/2016 Frisoni
9,366,467 B2 6/2016 Kiedaisch et al.
9,375,061 B2 6/2016 Mosee
D760,494 S 7/2016 Harvey-Pankey
D761,561 S 7/2016 Cheng
D762,378 S 8/2016 Domotor et al.
D762,384 S 8/2016 Boroski
D763,570 S 8/2016 Potts
D764,791 S 8/2016 Patel
D764,873 S 8/2016 Collie
9,408,445 B2 8/2016 Mogil et al.
D765,395 S 9/2016 Sanz
D765,967 S 9/2016 Boroski
D766,571 S 9/2016 Boroski
D768,981 S 10/2016 Kliot
D768,987 S 10/2016 Blumenfeld
D769,616 S 10/2016 Keene
D770,761 S 11/2016 Deioma et al.
D770,763 S 11/2016 Joo et al.
D771,372 S 11/2016 Kelly et al.
D772,562 S 11/2016 Petre
D773,813 S 12/2016 Jakubowski
9,521,883 B2 * 12/2016 Matsumoto ..... A44B 19/34
9,545,134 B1 * 1/2017 Tan ..... A44B 19/262
D778,045 S 2/2017 Ruddis
D778,609 S 2/2017 Gardner et al.
D782,820 S 4/2017 Thompson
D783,272 S 4/2017 Burton et al.
D784,010 S 4/2017 Dumas
9,630,750 B2 4/2017 Gardner et al.
D785,325 S 5/2017 Samrelius et al.
D785,930 S 5/2017 Sassi
D786,559 S 5/2017 Seiders et al.
D786,560 S 5/2017 Seiders et al.
D786,561 S 5/2017 Seiders et al.
D786,562 S 5/2017 Seiders et al.
D787,187 S 5/2017 Seiders et al.
D789,080 S 6/2017 Caffagni
D789,081 S 6/2017 Sassi
D789,082 S 6/2017 Barilaro et al.
D792,167 S 7/2017 Bradley
D792,486 S 7/2017 Li et al.
D793,089 S 8/2017 Jackson
D796,185 S 9/2017 Masten
D797,454 S 9/2017 Seiders et al.
D797,455 S 9/2017 Seiders et al.
D798,670 S 10/2017 Seiders et al.
D799,276 S 10/2017 Seiders et al.
D799,277 S 10/2017 Seiders et al.
D799,823 S 10/2017 Schartle
D799,905 S 10/2017 Seiders et al.
D800,443 S 10/2017 Burton et al.
D800,444 S 10/2017 Burton et al.
D801,123 S 10/2017 Seiders et al.
9,796,517 B2 10/2017 Seiders et al.
D802,028 S 11/2017 Li
D802,029 S 11/2017 Li
D802,373 S 11/2017 Seiders et al.
D802,630 S 11/2017 Li et al.
9,809,376 B2 11/2017 Mitchell et al.
D805,851 S 12/2017 Sullivan et al.
9,840,178 B2 12/2017 Baker
D808,157 S 1/2018 Viger et al.
D808,173 S 1/2018 Seiders et al.
D808,175 S 1/2018 Seiders et al.
D808,655 S 1/2018 Seiders et al.
D808,730 S 1/2018 Sullivan et al.
D809,869 S 2/2018 Seiders et al.
D811,082 S 2/2018 Lehan
9,901,153 B2 2/2018 Nash
D811,746 S 3/2018 Seiders et al.
D813,539 S 3/2018 Van Assche
9,907,369 B2 3/2018 Kelly et al.
D814,879 S 4/2018 Larson et al.
D815,496 S 4/2018 Larson et al.
9,943,150 B2 4/2018 Morrow
D817,106 S 5/2018 Larson et al.
D817,107 S 5/2018 Larson et al.
D817,722 S 5/2018 Bradley
D818,707 S 5/2018 Vevers et al.
9,981,780 B2 * 5/2018 Delasalle ..... B65D 33/255
D819,966 S 6/2018 Yu
D819,967 S 6/2018 Carter et al.
D821,094 S 6/2018 Dragicevic
D821,825 S 7/2018 Sullivan et al.
D822,987 S 7/2018 Seiders et al.
D822,997 S 7/2018 Seiders et al.
D822,998 S 7/2018 Seiders et al.
D822,999 S 7/2018 Seiders et al.
D823,601 S 7/2018 Seiders et al.
D823,602 S 7/2018 Seiders et al.
10,010,146 B2 7/2018 Moore
10,010,162 B1 7/2018 Woods et al.
10,029,842 B2 7/2018 Seiders et al.
D824,660 S 8/2018 Ross
D824,666 S 8/2018 Carter et al.
D824,671 S 8/2018 Pennington
D824,731 S 8/2018 Sullivan et al.
D827,299 S 9/2018 Vickery
D828,112 S 9/2018 Furneaux et al.
D828,728 S 9/2018 Jacobsen
D829,244 S 9/2018 Sullivan et al.
D830,048 S 10/2018 McQueeny
D830,132 S 10/2018 Sullivan et al.
D830,133 S 10/2018 Sullivan et al.
D830,134 S 10/2018 Sullivan et al.
D832,653 S 11/2018 Waskow et al.
10,138,048 B2 11/2018 Mitchell et al.
D834,815 S 12/2018 Barlier
D834,817 S 12/2018 Hoppe et al.
D834,895 S 12/2018 Triska et al.
D835,473 S 12/2018 Jacobsen
D835,949 S 12/2018 Triska et al.
D835,950 S 12/2018 Jacobsen
10,143,282 B2 12/2018 Seiders et al.
10,154,714 B2 12/2018 Wang
D836,996 S 1/2019 Jacobsen
D836,997 S 1/2019 Jacobsen
D836,998 S 1/2019 Jacobsen
D836,999 S 1/2019 Jacobsen
D837,000 S 1/2019 Jacobsen
D837,001 S 1/2019 Jacobsen
D838,978 S 1/2019 Lee
D839,682 S 2/2019 Jacobsen
D840,194 S 2/2019 Furneaux et al.
D840,689 S 2/2019 Seiders et al.
D840,761 S 2/2019 Seiders et al.
D840,762 S 2/2019 Seiders et al.
D840,763 S 2/2019 Seiders et al.
D840,764 S 2/2019 Seiders et al.
D841,325 S 2/2019 Buynar
D842,048 S 3/2019 Wells
10,226,110 B2 3/2019 Hayashi
D844,321 S 4/2019 Li
D844,975 S 4/2019 Munie et al.
D844,976 S 4/2019 Munie et al.
D844,977 S 4/2019 Munie et al.
D844,978 S 4/2019 Munie et al.

(56) References Cited

U.S. PATENT DOCUMENTS

D844,979 S 4/2019 Munie et al.
D844,992 S 4/2019 Seiders et al.
D845,625 S 4/2019 Barlier
D846,275 S 4/2019 Barlier
10,244,841 B2 4/2019 Hayashi
D847,500 S 5/2019 Lagerfeld
D847,501 S 5/2019 Carter et al.
D848,219 S 5/2019 Munie et al.
D848,220 S 5/2019 Munie et al.
D848,221 S 5/2019 Munie et al.
D848,222 S 5/2019 Munie et al.
D848,223 S 5/2019 Munie et al.
D848,798 S 5/2019 Munie et al.
D849,398 S 5/2019 Tan
D849,406 S 5/2019 Dehmoubed et al.
D849,486 S 5/2019 Munie et al.
10,279,980 B2 5/2019 James, Jr.
D850,107 S 6/2019 Dehmoubed et al.
D851,404 S 6/2019 Seiders et al.
D851,937 S 6/2019 Fuller
10,314,377 B2 6/2019 Stephens
10,322,867 B2 6/2019 Furneaux et al.
D853,201 S 7/2019 Collie
D853,728 S 7/2019 Seiders et al.
D855,982 S 8/2019 McGinn
10,384,855 B2 8/2019 Seiders et al.
D859,812 S 9/2019 Seiders et al.
D859,813 S 9/2019 Seiders et al.
D859,814 S 9/2019 Seiders et al.
D859,815 S 9/2019 Seiders et al.
D859,934 S 9/2019 Seiders et al.
D860,634 S 9/2019 Seiders et al.
10,413,030 B1 9/2019 Douglas et al.
D861,335 S 10/2019 Barlier
D861,338 S 10/2019 Seiders et al.
D862,065 S 10/2019 Boys et al.
D862,177 S 10/2019 Seiders et al.
D862,528 S 10/2019 Sullivan et al.
D866,186 S 11/2019 Seiders et al.
D867,823 S 11/2019 Jacobsen
D868,544 S 12/2019 Lin et al.
D869,146 S 12/2019 Jacobsen
D871,074 S 12/2019 Seiders et al.
D871,765 S 1/2020 Seiders et al.
D872,993 S 1/2020 Gu
D873,022 S 1/2020 Seip et al.
D877,514 S 3/2020 Seiders et al.
10,575,599 B2 * 3/2020 Cheng ..... A44B 19/26
D880,254 S 4/2020 Jacobsen
D880,862 S 4/2020 Seiders et al.
D881,561 S 4/2020 He
D882,956 S 5/2020 Seiders et al.
D886,537 S 6/2020 Jacobsen
D886,538 S 6/2020 Jacobsen
D886,539 S 6/2020 Jacobsen
D887,699 S 6/2020 Bullock et al.
10,736,391 B2 8/2020 Seiders et al.
D894,692 S 9/2020 Herold
D896,039 S 9/2020 Seiders et al.
D896,510 S 9/2020 Wen
D896,591 S 9/2020 Seiders et al.
10,781,028 B2 9/2020 Munie et al.
D897,780 S 10/2020 Seiders et al.
D899,197 S 10/2020 Seiders et al.
D899,865 S 10/2020 Shi
10,806,225 B2 * 10/2020 Sitnikova ..... A45C 7/0077
D902,664 S 11/2020 Munie et al.
10,827,808 B2 * 11/2020 Seiders ..... A45C 13/103
D903,305 S 12/2020 Sullivan et al.
D904,011 S 12/2020 Sullivan et al.
D904,031 S 12/2020 Chandler
D904,758 S 12/2020 Bullock et al.
D904,830 S 12/2020 Meda et al.
D906,058 S 12/2020 Sullivan et al.
D907,968 S 1/2021 Sullivan et al.
D907,969 S 1/2021 Sullivan et al.
D909,063 S 2/2021 Loudenslager et al.
D910,382 S 2/2021 Rane et al.
10,952,522 B2 3/2021 D'Alessandro
10,981,716 B2 4/2021 Seiders et al.
D918,570 S 5/2021 Seiders et al.
D918,571 S 5/2021 Davis
D919,298 S 5/2021 Munie
D919,375 S 5/2021 Seiders et al.
D919,376 S 5/2021 Seiders et al.
D920,677 S 6/2021 Tertoolen
D920,678 S 6/2021 Seiders et al.
D921,440 S 6/2021 Munie et al.
D922,149 S 6/2021 Munie et al.
D922,150 S 6/2021 Munie et al.
D922,151 S 6/2021 Munie et al.
D922,828 S 6/2021 Munie et al.
D923,323 S 6/2021 Seiders et al.
D926,532 S 8/2021 Munie et al.
D927,262 S 8/2021 Munie et al.
D931,614 S 9/2021 Seiders et al.
D935,175 S 11/2021 Rogers et al.
11,407,579 B2 8/2022 Munie et al.
2002/0012480 A1 1/2002 Konno
2002/0038811 A1 4/2002 Vigny
2002/0197369 A1 12/2002 Modler
2003/0070447 A1 4/2003 Tanaka
2003/0080133 A1 5/2003 Butler
2003/0106895 A1 6/2003 Kalal
2003/0106910 A1 6/2003 Ticks et al.
2003/0110599 A1 * 6/2003 Wang ..... A44B 19/40 24/396
2003/0136702 A1 7/2003 Redzisz et al.
2003/0149461 A1 8/2003 Johnson
2003/0175394 A1 9/2003 Modler
2004/0004111 A1 1/2004 Cardinale
2004/0028296 A1 2/2004 Meli
2004/0035143 A1 2/2004 Mogil
2004/0074936 A1 4/2004 McDonald
2004/0094589 A1 5/2004 Fricano
2004/0136621 A1 7/2004 Mogil
2004/0144783 A1 7/2004 Anderson et al.
2004/0149600 A1 8/2004 Wolter et al.
2004/0164084 A1 8/2004 Cooper
2004/0237266 A1 12/2004 Wang
2005/0016895 A1 1/2005 Glenn
2005/0034947 A1 2/2005 Nykoluk
2005/0040199 A1 2/2005 Emens et al.
2005/0045520 A1 3/2005 Johnson
2005/0045521 A1 3/2005 Johnson et al.
2005/0056669 A1 3/2005 Lavelle
2005/0072181 A1 4/2005 Mogil et al.
2005/0133399 A1 6/2005 Fidrych
2005/0155891 A1 7/2005 Chen
2005/0183446 A1 8/2005 Fuchs
2005/0196510 A1 9/2005 Walters
2005/0205459 A1 9/2005 Mogil et al.
2005/0262871 A1 12/2005 Bailey-Weston
2005/0263528 A1 12/2005 Maldonado et al.
2005/0279124 A1 12/2005 Maldonado
2006/0007266 A1 1/2006 Silverbrook
2006/0010660 A1 * 1/2006 Stenhall ..... A44B 19/34 24/389
2006/0021376 A1 2/2006 Scroggs
2006/0102497 A1 5/2006 Wulf
2006/0151533 A1 7/2006 Simunovic et al.
2006/0201979 A1 9/2006 Achilles
2006/0239593 A1 10/2006 Fidrych
2006/0240159 A1 10/2006 Cash et al.
2006/0248902 A1 11/2006 Hunnell
2006/0289586 A1 12/2006 Gregory
2007/0006430 A1 1/2007 Issler
2007/0012593 A1 1/2007 Kitchens et al.
2007/0017942 A1 1/2007 Hubbell
2007/0148305 A1 6/2007 Sherwood et al.
2007/0148307 A1 6/2007 Sherwood et al.
2007/0164063 A1 7/2007 Concepcion
2007/0199966 A1 8/2007 Korchmar
2007/0215663 A1 9/2007 Chongson et al.

(56) References Cited

U.S. PATENT DOCUMENTS

2007/0217187 A1 9/2007 Blakely et al.
2007/0221693 A1 9/2007 Moore
2007/0237432 A1 10/2007 Mogil
2007/0261977 A1 11/2007 Sakai
2007/0274613 A1 11/2007 Pruchnicki et al.
2007/0278234 A1 12/2007 Mogil
2007/0290816 A1 12/2007 Bedard
2008/0038424 A1 2/2008 Krusemann
2008/0073364 A1 3/2008 Simmons
2008/0105282 A1 5/2008 Fernholz et al.
2008/0116697 A1 5/2008 D'Ambrosio
2008/0128421 A1 6/2008 Ulbrand et al.
2008/0142518 A1 6/2008 Maistrellis
2008/0160149 A1 7/2008 Nasrallah et al.
2008/0164265 A1 7/2008 Conforti
2008/0178865 A1 7/2008 Retterer
2008/0189918 A1* 8/2008 Kusayama ..... A44B 19/32 29/408
2008/0245096 A1 10/2008 Hanson et al.
2008/0260303 A1 10/2008 De Lesseux et al.
2008/0264925 A1 10/2008 Lockhart et al.
2008/0305235 A1 12/2008 Gao et al.
2009/0029109 A1 1/2009 Seth et al.
2009/0052809 A1 2/2009 Sampson
2009/0080808 A1 3/2009 Hagen
2009/0095757 A1 4/2009 Ramundi
2009/0242619 A1 10/2009 Blomberg
2009/0280229 A1 11/2009 Constantine et al.
2009/0301511 A1 12/2009 Vinci
2009/0311378 A1 12/2009 Wilaschin et al.
2009/0317514 A1 12/2009 Sizer
2010/0005827 A1 1/2010 Winkler
2010/0047423 A1 2/2010 Kruesemann et al.
2010/0059199 A1 3/2010 Court
2010/0071395 A1 3/2010 Ledoux et al.
2010/0075006 A1 3/2010 Semenza
2010/0102057 A1 4/2010 Long et al.
2010/0108694 A1 5/2010 Sedlbauer et al.
2010/0125982 A1* 5/2010 Chou ..... A44B 19/32 24/397
2010/0136203 A1 6/2010 Sakata et al.
2010/0143567 A1 6/2010 Ye et al.
2010/0224660 A1 9/2010 Gleason
2010/0269311 A1* 10/2010 Jacobsen ..... A44B 19/34 24/382
2010/0284631 A1 11/2010 Lee
2010/0284634 A1 11/2010 Hadley
2011/0003975 A1 1/2011 Arase et al.
2011/0005042 A1* 1/2011 Thomas ..... A44B 19/32 24/381
2011/0005739 A1 1/2011 Finney et al.
2011/0030415 A1 2/2011 Breyburg et al.
2011/0097442 A1 4/2011 Harju et al.
2011/0108562 A1 5/2011 Lyons
2011/0155611 A1 6/2011 Armstrong
2011/0167863 A1 7/2011 Herrbold
2011/0182532 A1 7/2011 Baltus
2011/0191933 A1 8/2011 Gregory et al.
2011/0284601 A1 11/2011 Pullin
2011/0311166 A1 12/2011 Pascua
2012/0106130 A1 5/2012 Beaudette
2012/0137637 A1 6/2012 Gillis
2012/0180184 A1 7/2012 Crye
2012/0181211 A1 7/2012 Charlebois
2012/0187138 A1 7/2012 Vasquez et al.
2012/0261445 A1 10/2012 Demskey
2012/0294550 A1 11/2012 Hassman et al.
2012/0311828 A1 12/2012 Nir
2012/0318808 A1 12/2012 McCormick
2013/0014355 A1 1/2013 Lee
2013/0043285 A1 2/2013 Cordray
2013/0174600 A1 7/2013 Sarcinella
2013/0200083 A1 8/2013 Cunningham
2013/0216158 A1 8/2013 Meldeau et al.
2013/0243354 A1 9/2013 Lytle
2013/0264350 A1 10/2013 Handlon et al.
2013/0283845 A1 10/2013 Baumann et al.
2013/0294712 A1 11/2013 Seuk
2013/0341338 A1 12/2013 Mitchell et al.
2014/0023295 A1 1/2014 Wagner
2014/0034543 A1 2/2014 Grubstein
2014/0119678 A1 5/2014 Ausnit et al.
2014/0138378 A1 5/2014 Lequeux
2014/0151172 A1 6/2014 Diaz
2014/0226920 A1 8/2014 Passavia
2014/0248003 A1 9/2014 Mogil et al.
2014/0254956 A1 9/2014 Buell, III
2014/0270590 A1 9/2014 Ostroy
2014/0304954 A1* 10/2014 La Rocca ..... A44B 19/32 24/389
2014/0345314 A1 11/2014 Cox et al.
2014/0353347 A1 12/2014 Fischer
2014/0359978 A1* 12/2014 Wang ..... A44B 19/32 29/408
2014/0366336 A1* 12/2014 Chung ..... A44B 19/16 24/389
2014/0369629 A1 12/2014 De La Fuente Lara
2015/0008242 A1 1/2015 Kpabar, Jr.
2015/0096153 A1 4/2015 Matsumoto et al.
2015/0114024 A1 4/2015 Grepper
2015/0114978 A1 4/2015 James, Jr.
2015/0136796 A1 5/2015 Muehlhauser
2015/0143672 A1* 5/2015 Konaka ..... A44B 19/34 428/221
2015/0164153 A1* 6/2015 Tsai ..... A41D 3/04 2/87
2015/0175338 A1 6/2015 Culp et al.
2015/0201722 A1 7/2015 Brouard
2015/0225164 A1* 8/2015 Seiders ..... B65D 25/18 220/592.25
2015/0296945 A1 10/2015 Douglas
2015/0305402 A1 10/2015 Bourgoin
2015/0335202 A1 11/2015 Wisner et al.
2015/0353263 A1 12/2015 Seiders et al.
2016/0058142 A1 3/2016 Buynar
2016/0066817 A1 3/2016 Hannes
2016/0095405 A1* 4/2016 Wang ..... A44B 19/42 24/381
2016/0100661 A1 4/2016 Redzisz et al.
2016/0100673 A1 4/2016 Demskey
2016/0101924 A1 4/2016 Mitchell et al.
2016/0107801 A1* 4/2016 Armstrong ..... B65D 33/2541 24/30.5 L
2016/0107816 A1 4/2016 Larpenteur et al.
2016/0198812 A1* 7/2016 Tan ..... A44B 19/22 24/389
2016/0198901 A1 7/2016 De Lesseux et al.
2016/0221722 A1 8/2016 Burke et al.
2016/0236849 A1 8/2016 Seiders et al.
2016/0255943 A1 9/2016 Houston et al.
2016/0257479 A1 9/2016 Seiders et al.
2016/0338462 A1 11/2016 Hayashi
2016/0338908 A1 11/2016 Rice et al.
2016/0355319 A1 12/2016 Stephens
2017/0036844 A1* 2/2017 Seiders ..... A45C 3/001
2017/0066559 A1 3/2017 Kim et al.
2017/0071304 A1 3/2017 Wang
2017/0071305 A1 3/2017 Wang
2017/0099920 A1 4/2017 Bailey
2017/0119116 A1 5/2017 Bradley
2017/0121059 A1 5/2017 Faris
2017/0137205 A1 5/2017 Graf et al.
2017/0208907 A1* 7/2017 Chung ..... A44B 19/36
2017/0210542 A1 7/2017 Seiders et al.
2017/0225872 A1 8/2017 Collie
2017/0265604 A1* 9/2017 Martinson ..... A44B 19/16
2017/0280937 A1 10/2017 Mogil et al.
2018/0016084 A1 1/2018 Xia et al.
2018/0078008 A1* 3/2018 Sturm ..... A44B 19/32
2018/0087819 A1 3/2018 Triska et al.
2018/0098607 A1 4/2018 Seiders et al.
2018/0162626 A1 6/2018 Munie et al.
2018/0220760 A1 8/2018 Lin

(56) References Cited

U.S. PATENT DOCUMENTS

| | | | | |
|---|---|---|---|---|
| 2018/0229911 | A1 | 8/2018 | Luo | |
| 2018/0235324 | A1* | 8/2018 | Gordon | A44B 19/36 |
| 2018/0242701 | A1 | 8/2018 | Seiders et al. | |
| 2018/0252458 | A1 | 9/2018 | Furneaux et al. | |
| 2018/0263346 | A1 | 9/2018 | Stephens | |
| 2018/0279733 | A1 | 10/2018 | Young et al. | |
| 2018/0317620 | A1 | 11/2018 | Larson et al. | |
| 2018/0360172 | A1* | 12/2018 | Chou | B29C 45/2708 |
| 2018/0370710 | A1 | 12/2018 | Luo | |
| 2019/0008256 | A1 | 1/2019 | Basham | |
| 2019/0037976 | A1* | 2/2019 | Cheng | A44B 19/32 |
| 2019/0071238 | A1 | 3/2019 | Seiders et al. | |
| 2019/0077577 | A1 | 3/2019 | Brandes | |
| 2019/0133281 | A1 | 5/2019 | Munie et al. | |
| 2019/0142116 | A1* | 5/2019 | Cheng | A44B 19/34 24/389 |
| 2019/0142117 | A1* | 5/2019 | Myerscough | A44B 19/36 24/415 |
| 2019/0170422 | A1 | 6/2019 | Dexter | |
| 2020/0029658 | A1* | 1/2020 | Zhang | A44B 19/32 |
| 2020/0037711 | A1* | 2/2020 | Kayahara | A44B 19/36 |
| 2020/0172320 | A1 | 6/2020 | Dong | |
| 2021/0345740 | A1 | 11/2021 | Seiders et al. | |

FOREIGN PATENT DOCUMENTS

| | | | |
|---|---|---|---|
| AU | 201614230 | S | 8/2016 |
| BE | 1015808 | A6 | 9/2005 |
| BR | 302019001991-0001 | | 10/2019 |
| CA | 2243820 | A1 | 1/2000 |
| CA | 89737 | A | 6/2000 |
| CA | 2300014 | A1 | 8/2001 |
| CA | 2327764 | A1 | 6/2002 |
| CA | 2433251 | A1 | 12/2004 |
| CA | 2483802 | A1 | 4/2006 |
| CA | 2498796 | A1 | 9/2006 |
| CA | 2499291 | A1 | 9/2006 |
| CA | 2503473 | A1 | 10/2006 |
| CA | 2548064 | A1 | 11/2007 |
| CA | 2549327 | A1 | 11/2007 |
| CA | 2633223 | A1 | 12/2009 |
| CA | 2782668 | A1 | 12/2013 |
| CA | 163677 | A | 6/2016 |
| CN | 2125339 | U | 12/1992 |
| CN | 2188899 | Y | 2/1995 |
| CN | 2207742 | Y | 9/1995 |
| CN | 2296114 | Y | 11/1998 |
| CN | 1832826 | A | 9/2006 |
| CN | 1883333 | A | 12/2006 |
| CN | 3650531 | | 5/2007 |
| CN | 201062136 | Y | 5/2008 |
| CN | 101284425 | A | 10/2008 |
| CN | 201351017 | Y | 11/2009 |
| CN | 101733364 | A | 6/2010 |
| CN | 201550711 | U | 8/2010 |
| CN | 201948200 | U | 8/2011 |
| CN | 101500900 | B | 9/2011 |
| CN | 102232160 | A | 11/2011 |
| CN | 202143500 | U | 2/2012 |
| CN | 301956022 | | 6/2012 |
| CN | 302004566 | S | 7/2012 |
| CN | 102717977 | A | 10/2012 |
| CN | 302137314 | | 10/2012 |
| CN | 202619972 | U | 12/2012 |
| CN | 102858208 | A | 1/2013 |
| CN | 202635944 | U | 1/2013 |
| CN | 202807322 | U | 3/2013 |
| CN | 202959175 | U | 6/2013 |
| CN | 203096979 | U | 7/2013 |
| CN | 302500079 | S | 7/2013 |
| CN | 302554919 | S | 9/2013 |
| CN | 103385657 | A | 11/2013 |
| CN | 203283602 | U | 11/2013 |
| CN | 302623771 | | 11/2013 |
| CN | 302623775 | | 11/2013 |
| CN | 302738897 | S | 2/2014 |
| CN | 302744932 | S | 2/2014 |
| CN | 302746176 | | 2/2014 |
| CN | 302769710 | | 3/2014 |
| CN | 103763994 | A | 4/2014 |
| CN | 302868215 | | 7/2014 |
| CN | 302877656 | | 7/2014 |
| CN | 104085612 | A | 10/2014 |
| CN | 302956550 | | 10/2014 |
| CN | 204091227 | U | 1/2015 |
| CN | 204120419 | U | 1/2015 |
| CN | 303100086 | | 2/2015 |
| CN | 104709603 | A | 6/2015 |
| CN | 204444667 | U | 7/2015 |
| CN | 104839947 | A | 8/2015 |
| CN | 204548946 | U | 8/2015 |
| CN | 204585423 | U | 8/2015 |
| CN | 303342902 | | 8/2015 |
| CN | 204763894 | U | 11/2015 |
| CN | 204802380 | U | 11/2015 |
| CN | 303459386 | | 11/2015 |
| CN | 105231621 | A | 1/2016 |
| CN | 105520325 | A | 4/2016 |
| CN | 105819110 | A | 8/2016 |
| CN | 105874896 | A | 8/2016 |
| CN | 304154180 | | 6/2017 |
| CN | 304181831 | | 6/2017 |
| CN | 304207295 | | 7/2017 |
| CN | 304259949 | | 8/2017 |
| CN | 304342577 | | 11/2017 |
| CN | 304373532 | | 11/2017 |
| CN | 304527075 | | 3/2018 |
| CN | 304785791 | S | 8/2018 |
| CN | 304906858 | | 11/2018 |
| CN | 208259266 | U | 12/2018 |
| CN | 305025150 | S | 2/2019 |
| CN | 305033965 | S | 2/2019 |
| CN | 305272180 | S | 7/2019 |
| CN | 209807329 | U | 12/2019 |
| CN | 305527294 | S | 1/2020 |
| CN | 305770022 | S | 5/2020 |
| CN | 305873216 | S | 6/2020 |
| CN | 305881796 | S | 6/2020 |
| CN | 305916378 | S | 7/2020 |
| CN | 306245278 | S | 12/2020 |
| CN | 306245283 | S | 12/2020 |
| CN | 306264645 | S | 1/2021 |
| CN | 306365124 | S | 3/2021 |
| CN | 306365279 | S | 3/2021 |
| CN | 306765257 | S | 5/2021 |
| CN | 306616705 | S | 6/2021 |
| CN | 306624319 | S | 6/2021 |
| CN | 306657146 | S | 7/2021 |
| CN | 306674956 | S | 7/2021 |
| DE | 3539626 | A1 | 5/1987 |
| DE | 9309197 | U1 | 11/1993 |
| DE | 20002689 | U1 | 8/2000 |
| DE | 202011050174 | U1 | 7/2011 |
| DE | 202013101115 | U1 | 3/2013 |
| DE | 402018000462-0021 | | 9/2018 |
| EM | 000122668-0002 | | 5/2004 |
| EM | 001067250-0003 | | 2/2009 |
| EM | 001188460-0003 | | 2/2010 |
| EM | 001188460-0004 | | 2/2010 |
| EM | 001909490-0001 | | 8/2011 |
| EM | 001952722-0008 | | 11/2011 |
| EM | 002073452-0001 | | 8/2012 |
| EM | 002085308-0003 | | 8/2012 |
| EM | 002163527-0017 | | 1/2013 |
| EM | 002182642-0001 | | 2/2013 |
| EM | 002225706-0001 | | 5/2013 |
| EM | 002262436-0001 | | 7/2013 |
| EM | 002264697-0002 | | 7/2013 |
| EM | 002284729-0004 | | 8/2013 |
| EM | 002322552-0001 | | 10/2013 |
| EM | 002476853-0001 | | 6/2014 |
| EM | 002476853-0002 | | 6/2014 |
| EM | 002530519-0001 | | 9/2014 |

(56) References Cited

FOREIGN PATENT DOCUMENTS

| | | | |
|---|---|---|---|
| EM | 002605345-0004 | | 12/2014 |
| EM | 002609404-0001 | | 1/2015 |
| EM | 002676536-0001 | | 6/2015 |
| EM | 002745190-0001 | | 9/2015 |
| EM | 003117324-0009 | | 5/2016 |
| EM | 003329929-0001 | | 8/2016 |
| EM | 003409044-0008 | | 10/2016 |
| EM | 003504331-0027 | | 12/2016 |
| EM | 003733021-0001 | | 2/2017 |
| EM | 004100048-0001 | | 9/2017 |
| EM | 004100048-0002 | | 9/2017 |
| EM | 003328608-0009 | | 2/2019 |
| EM | 005954534-0001 | | 3/2019 |
| EM | 005954534-0002 | | 3/2019 |
| EM | 005954534-0003 | | 3/2019 |
| EM | 005954534-0004 | | 3/2019 |
| EM | 007558580-0001 | | 5/2020 |
| EM | 008206833-0014 | | 10/2020 |
| EM | 008206833-0015 | | 10/2020 |
| EM | 008206833-0016 | | 10/2020 |
| EM | 008149702-0001 | | 11/2020 |
| EM | 008149702-0002 | | 11/2020 |
| EM | 008149702-0003 | | 11/2020 |
| EM | 006820619-0001 | | 12/2020 |
| EM | 008306195-0001 | | 12/2020 |
| EM | 008592307-0001 | | 7/2021 |
| EP | 0037545 | A2 | 10/1981 |
| EP | 0082131 | A2 | 6/1983 |
| EP | 85534 | A1 | 8/1983 |
| EP | 0158634 | A1 | 10/1985 |
| EP | 0174159 | A2 | 3/1986 |
| EP | 0238932 | A1 | 9/1987 |
| EP | 1386557 | B1 | 4/2007 |
| EP | 2281961 | A1 | 2/2011 |
| EP | 003811264-0010 | | 3/2017 |
| EP | 003841857-0002 | | 4/2017 |
| EP | 004122430-0001 | | 8/2017 |
| EP | 004162337-0001 | | 9/2017 |
| EP | 004162337-0002 | | 9/2017 |
| EP | 004162337-0003 | | 9/2017 |
| EP | 004162337-0004 | | 9/2017 |
| EP | 004162337-0005 | | 9/2017 |
| EP | 004162337-0006 | | 9/2017 |
| EP | 004424059-0002 | | 10/2017 |
| EP | 004417749-0003 | | 11/2017 |
| EP | 004494086-0016 | | 11/2017 |
| EP | 004494086-0017 | | 11/2017 |
| EP | 002719245-0001 | | 1/2018 |
| EP | 005269248-0002 | | 5/2018 |
| EP | 005303559-0001 | | 7/2018 |
| EP | 005303559-0003 | | 7/2018 |
| ES | 00530973-34 | | 1/2020 |
| FR | 1269009 | A | 8/1961 |
| FR | 2440886 | A1 | 6/1980 |
| FR | 20182961-001 | | 9/2018 |
| GB | 191415563 | A | 6/1915 |
| GB | 1600133 | A | 10/1981 |
| GB | 2249717 | A | 5/1992 |
| GB | 2023549 | A | 9/1992 |
| GB | 2282874 | A | 4/1995 |
| GB | 2335972 | A | 10/1999 |
| GB | 3004135 | | 9/2002 |
| GB | 3006367 | | 10/2002 |
| GB | 6028395 | | 2/2018 |
| GB | 9008149702-0001 | | 8/2020 |
| GB | 9008149702-0002 | | 8/2020 |
| GB | 9008149702-0003 | | 8/2020 |
| GB | 9008306195-0001 | | 12/2020 |
| JP | 11051532 | | 2/1999 |
| JP | 3059471 | U | 7/1999 |
| JP | 2000157335 | A | 6/2000 |
| JP | 3275477 | B2 | 4/2002 |
| JP | D1160335 | | 12/2002 |
| JP | 2003026258 | A | 1/2003 |
| JP | 2004238003 | A | 8/2004 |
| JP | D1213384 | | 8/2004 |
| JP | D1242111 | | 6/2005 |
| JP | 2010023926 | A | 2/2010 |
| JP | D1445624 | | 7/2012 |
| JP | D1469606 | | 5/2013 |
| JP | 2015107825 | A | 6/2015 |
| JP | D1531414 | | 8/2015 |
| JP | D1543325 | | 8/2015 |
| JP | D1658594 | | 4/2020 |
| KR | 20020027739 | A | 4/2002 |
| KR | 30-0311990 | | 11/2002 |
| KR | 20040092730 | A | 11/2004 |
| KR | 30-0467684 | | 11/2007 |
| KR | 20110124449 | A | 11/2011 |
| KR | 101228371 | B1 | 1/2013 |
| KR | 101282512 | B1 | 7/2013 |
| KR | 300778570.0000 | | 1/2015 |
| KR | 300808669.0000 | | 8/2015 |
| KR | 300835242.0000 | | 1/2016 |
| KR | 300853718.0000 | | 5/2016 |
| KR | 300967041.0000 | | 8/2018 |
| KR | 300968949.0000 | | 8/2018 |
| KR | 300978269.0000 | | 10/2018 |
| KR | 300982993.0000 | | 11/2018 |
| KR | 300984157.0000 | | 12/2018 |
| KR | 200488239 | Y1 | 1/2019 |
| KR | 300990517.0000 | | 1/2019 |
| KR | 300990523.0000 | | 1/2019 |
| KR | 301004401.0000 | | 4/2019 |
| KR | 301062695.0000 | | 6/2020 |
| KR | 301084294.0000 | | 11/2020 |
| KR | 301108516.0000 | | 5/2021 |
| KR | 3020210000796 | | 7/2021 |
| KR | 301123726.0000 | | 8/2021 |
| SG | 93463 | A1 | 1/2003 |
| TW | 126351 | | 1/1990 |
| TW | M572678 | U | 1/2019 |
| WO | 9524146 | A2 | 9/1995 |
| WO | 9812954 | A1 | 4/1998 |
| WO | 02058500 | A1 | 8/2002 |
| WO | 2006007266 | A2 | 1/2006 |
| WO | 2006058538 | A1 | 6/2006 |
| WO | 2007016092 | A2 | 2/2007 |
| WO | 2010106296 | A2 | 9/2010 |
| WO | 2010120199 | A1 | 10/2010 |
| WO | 2012003543 | A1 | 1/2012 |
| WO | 2014033450 | A1 | 3/2014 |
| WO | 2014066026 | A1 | 5/2014 |
| WO | 2016066817 | A1 | 5/2016 |
| WO | 2017091761 | A1 | 6/2017 |
| WO | 2017136754 | A1 | 8/2017 |
| WO | 17197230 | A1 | 11/2017 |
| WO | 2018152402 | A1 | 8/2018 |
| WO | 2018165426 | A1 | 9/2018 |
| WO | 19135922 | A1 | 7/2019 |

OTHER PUBLICATIONS

Apr. 13, 2022—(CN) Third Office Action—App. No. 201880035443.0.

Mar. 20, 2020—(CN) Office Action—App. No. 201680076714.8.

Jul. 14, 2020—(CA) Office Action—App. No. 3024101.

First Look: YETI Hopper Flip Soft Cooler Review | GearJunkie which was published on the website; https://gearjunkie.com/review-yeti-hopper-flip-12-soft-cooler on Jul. 12, 2016.

YETI Flip Review—YouTube which was published on the website https://www.youtube.com/watch?v=97Vdb3lazdw on Sep. 3, 2016.

Jul. 2, 2020—(AU) First Office Action—App. No. 201712263.

Jul. 2, 2020—(AU) First Office Action—App. No. 201712262.

Jul. 2, 2020—(AU) First Office Action—App. No. 201712264.

Jul. 2, 2020—(AU) First Office Action—App. No. 201712265.

Jul. 31, 2020—(CN) Second Office Action (with English Translation)—App. No. 201780020473.X.

Aug. 17, 2020—(CN) Third Office Action (with English Translation)—App. No. 201680076714.8.

Oct. 19, 2020—(NZ) Patent Examination Report 1—App. No. 759046.

(56) References Cited

OTHER PUBLICATIONS amazon.com, "Meal Prep Lunch Bag/Box for Men, Women+3 Large Food Containers (45oz)+2 Big Reusable Ice Packs+Shoulder Strap+Shaker With Storage. Insulated Lunchbox Cooler Tote. Adult Portion Control Set," visited May 7, 2019 at <https://www.amazon.com/Meal-Containers-Reusable-Shoulder-Insulated/dp/B01MU2YS18/>.
amazon.com, "MIER Portable Thermal Insulated Cooler Bag Mini Lunch Bag for Kids, Black," visited May 7, 2019, at <https://www.amazon.com/MIER-Portable-Thermal-Insulated-Cooler/dp/B01145L2JM/>.
Jan. 12, 2021—(CN) Fourth Office Action—App. No. 201680076714.8.
Feb. 3, 2021—(EP) Extended Search Report—App. No. 18813247.6.
United States District Court Southern District of Texas Houston Division, "Plaintiff YETI's Complaint for Patent Infringement", *YETI Coolers, LLC* v. *Igloo Products Corporation*, Case 4:21-cv-00505, filed Feb. 12, 2021, 98 pages.
Feb. 24, 2021—(WO) International Search Report & Written Opinion—PCT/US20/059783.
United States District Court Western District of Texas, Austin Division, "Complaint for Damages and Injunctive Relief for: (1)-(12) Patent Infringement in Violation of 35 U.S.C. § 271; and (13) Breach of Contract", *YETI Coolers, LLC* v. *RTIC Outdoors, LLC; and Corporate Support & Fulfillment, LLC*, Case 1:21-cv-00214, filed Mar. 5, 2021, 338 pages.
Apr. 7, 2021—(NZ) Examination Report 2—App. No. 759046.
Apr. 6, 2021—(CN) First Office Action—App. No. 201880035443.0.
Apr. 26, 2021—(CN) Rejection Decision—App. No. 201680076714.8.
United States District Court Western District of Texas, Austin Division, "First Amended Complaint, 'Complaint for Damages and Injunctive Relief for: (1)-(15) Patent Infringement in Violation of 35 U.S.C. § 271; and (16) Breach of Contract'", *YETI Coolers, LLC* v. *RTIC Outdoors, LLC; and Corporate Support & Fulfillment, LLC*, Case 1:21-cv-00214-RP, Document 10, filed Jun. 2, 2021, 39 pages.
United States District Court Western District of Texas, Austin Division, "Answer of Defendants RTIC Outdoors, LLC and Corporate Support & Fulfillment, LLC to YETI's Amended Complaint: (1)-(15) Patent Infringement in Violation of 35 U.S.C. § 271; and (16) Breach of Contract ", *YETI Coolers, LLC* v. *RTIC Outdoors, LLC; and Corporate Support & Fulfillment, LLC*, Case 1:21-cv-00214-RP, Document 16, filed Jun. 17, 2021, 79 pages.
United States District Court Eastern District of Missouri Eastern Division, "Complaint, 'Complaint for Damages and Injunctive Relief'", *YETI Coolers, LLC* v. *Discover Home Products, LLC*, Case 4:21-cv-00836, Document 1, filed Jul. 9, 2021, 68 pages.
Jan. 20, 2021—(CN) Third Office Action—App. No. 201780020473.X.
May 7, 2021—(CN) Rejection Decision—App. No. 201780020473.X.
amazon.com, "Lille Home 2nd Gen 22oz Stainless Steel Leakproof Lunch Box, Insulated Bento Box/Food Container with Insulated Lunch Bag | Durable Handles and Lid | Adults, Kids | Men, Women (Green)," visited May 8, 2019 at <https://www.amazon.com/dp/B07MBDD29C/>.
Jun. 28, 2021—(EP) Office Action—App. No. 18830667.4.
Sep. 3, 2021—(CN) First Office Action—App. No. 201880070523.X.
Jun. 16, 2021—(CN) Evaluation Report of Design Patent—App. No. ZL201630369163.7.
Jul. 15, 2022—(CN) Decision on Rejection—App. No. 201880035443.0.
Jul. 8, 2022—(JP) Decision of Rejection—App. No. 2019566329.
United States District Court Western District of Texas, Austin Division, "Second Amended Complaint", *YETI Coolers, LLC* v. *RTIC Outdoors, LLC; and Corporate Support & Fulfillment, LLC*, Case 1:21-cv-00214-RP, Document 33, filed Dec. 17, 2021, 489 pages.
United Stated District Court Western District of Texas, Austin Division, "Answer of Defendants RTIC Outdoors, LLC and Corporate Support & Fulfillment, LLC to YETI's Second Amended Complaint, Jury Trial Demanded", *YETI Coolers, LLC* v. *RTIC Outdoors, LLC; and Corporate Support & Fulfillment, LLC*, Case 1:21-cv-00214-RP, Document 34, filed Jan. 3, 2022, 92 pgs.
Jan. 21, 2022—(JP) Office Action—App. No. 2019-566329.
Jan. 26, 2022—(EP) Office Action—App. No. 18830667.4.
Apr. 19, 2022—(CN) Second Office Action—App. No. 201880070523.X.
May 22, 2015—U.S. Non-Final Office Action—U.S. Appl. No. 14/479,607.
Jan. 31, 2017—(WO) International Search Report and Written Opinion—App. PCT/US2016/060135.
Mar. 27, 2017—(WO) International Search Report and Written Opinion—App PCT/US2017/016552.
May 30, 2017—(WO) ISR—App. No. PCT/US17/32351.
May 30, 2017—(WO) Written Opinion—App. No. PCT/US17/32351.
May 8, 2017—U.S. Non-Final Office Action—U.S. Appl. No. 15/154,626.
Nov. 24, 2017—U.S. Final Office Action—U.S. Appl. No. 15/154,626.
Sep. 13, 2017—U.S. Final Office Action—U.S. Appl. No. 15/137,838.
Aug. 29, 2018 (WO)—International Search Report and Written Opinion—App. No. PCT/US18/36608.
Feb. 9, 2018—U.S. Non-Final Office Action—U.S. Appl. No. 15/451,064.
May 24, 2018—US. Non-final Office Action—U.S. Appl. No. 15/790,926.
Mar. 21, 2019—(WO) International Search Report and Written Opinion—App. No. PCT/US2018/066040.
Devonbuy.com: Thule Gauntlet 13" MacBook Pro Attaché. Published on Jul. 28, 2014. Retrieved from the internet at <http://www.devonbuy.com/thule-gauntlet-13-macbook-pro-attache/>, Feb. 24, 2016. 9 pages.
Ebags, Picnic Pack Picnic Pack Large Insulated Cooler Tote, First reviewed on Jul. 20, 2016. Accessed Feb. 7, 2017. (http://www.ebags.com/product/picnic-pack/picnic-pack-large-insulated-cooler-tote/313704?productid=10428840).
Good Housekeeping, "Lands' End Zip Top Cooler Tote #433786", Reviewed on Apr. 2014, Accessed Nov. 18, 2017. (http://www.goodhousekeeping.com/travel-products/food-cooler-reviews/a33270/lands-end-zip-top-cooler-tote-433786/).
Home Shopping Network, "Built New York Large Welded Cooler Bag", Accessed Nov. 18, 2017. (https://www.hsn.com/products/built-new-york-large-welded-cooler-bag/8561 033).
Icemule Classic Cooler—Large (20L), http://www.icemulecooler.com/icemule-classic-cooler-large-201/, published date unknown, but prior to the filing date of the present application, ICEMULE, United States.
Petition for Inter Partes Review of U.S. Pat. No. 9139352, filed on Dec. 13, 2016, 1616 pages.
Stopper Dry Bag, http://www.seatosummit.com/products/display/181, published date unknown, but prior to the filing date of the present application, Sea to Summit, United States.
TheGadgeteer.com: Tom Bihn Camera I-O Bag Review. Published Jul. 9, 2012. Retrieved from the internet at <http://the-gadgeteer.com/2012/07/09/tom-bihn-camera-i-o-bag-review/>, Jan. 11, 2016. 7 pages.
United States District Court for the Western District of Texas, Austin Division, "Defendants' Answer and Counterclaims to YETI's Complaint," *YETI Coolers, LLC*, vs. *RTIC Soft Sided Coolers, LLC, RTIC Coolers, LLC, RTIC Web Services, LLC, and Corporate Support and Fulfillment, LLC*, Case 1:16-cv-00909-RP, Document 11, Filed Aug. 18, 2016, 44 pages.
United States District Court for the Western District of Texas, Austin Division, "Defendants' Rule 12(B)(6) Motion to Dismiss for Failure to State a Claim," *YETI Coolers, LLC*, vs. *RTIC Soft Sided Coolers, LLC, RTIC Coolers, LLC, RTIC Web Services, LLC, and Corporate*

(56) References Cited

OTHER PUBLICATIONS

*Support and Fulfillment, LLC*, Case 1:16-cv-00909-RP, Document 10, Filed Aug. 18, 2016, 12 pages.
United States District Court for the Western District of Texas, Austin Division, "Joint Rule 26(f) Report and Discovery Plan," *YETI Coolers, LLC*, vs. *RTIC Soft Sided Coolers, LLC, RTIC Coolers, LLC, RTIC Web Services, LLC, and Corporate Support and Fulfillment, LLC*, Case 1:16-cv-00909-RP, Document 19, Filed Oct. 11, 2016, 9 pages.
United States District Court Western District of Texas Austin Division, "Complaint," *YETI Coolers, LLC* v. *Glacier Coolers, LLC, and Tecomate Holdings, LLC*, Case 1:17-cv-00586, Document 1, filed Jun. 15, 2017, 161 pages.
United States District Court Western District of Texas, Austin Division, "Complaint for Damages and Injunctive Relief," *YETI Coolers, LLC* v. *Jennifer Leverne Bootz Evans* d/b/a Bling and Burlap Buy In's and Blanks, Case 1:15-cv-00995, Document 1, Filed Nov. 2, 2015, 128 pages.
United States District Court Western District of Texas, Austin Division, "Complaint," *YETI Coolers, LLC*, v. *RTIC Soft Side Coolers, RTIC Coolers, LLC, RTIC Web Services, LLC, and Corporate Support and Fulfillment, LLC*, Case 1:16-cv-00909, Document 1, Filed Jul. 27, 2016, 66 pages.
United States District Court Western District of Texas, Austin Division, "Defendant's Reply in Support of Their Rule 12(B)(6) Motion to Dismiss for Failure to State a Claim" *YETI Coolers, LLC* v. *RTIC Soft Sided Coolers, LLC, RTIC Coolers, LLC, RTIC Web Services, LLC, and Corporate Support and Fulfillment, LLC*, Case 1:16-cv-00909-RP, Document 15, Filed Sep. 8, 2016, 13 pages.
United States District Court Western District of Texas, Austin Division, "Order," *YETI Coolers, LLC* v. *Jennifer Leverne Bootz Evans* d/b/a Bling and Burlap Buy In's and Blanks, Case 1:15-cv-00995-RP, Document 18, Filed Apr. 18, 2016, 1 page.
United States District Court Western District of Texas, Austin Division, "YETI's Answer to RTICs Counterclaims," *YETI Coolers, LLC* v. *RTIC Soft Sided Coolers, LLC, RTIC Coolers, LLC, RTIC Web Services, LLC, and Corporate Support and Fulfillment, LLC*, Case 1:16-cv-00909-RP, Document 14, Filed Sep. 2, 2016, 16 pages.
United States District Court Western District of Texas, Austin Division, "YETI's Opposition to RTIC's Motion to Dismiss," *YETI Coolers, LLC* v. *RTIC Soft Sided Coolers, LLC, RTIC Coolers, LLC, RTIC Web Services, LLC, and Corporate Support and Fulfillment, LLC*, Case 1:16-cv-00909-RP, Document 13, Filed Sep. 1, 2016, 17 pages.
United States Patent and Trademark Office Before the Patent Trial and Appeal Board, Decisions Joint Motions to Terminate Inter Partes Review, Entered Mar. 22, 2017—(4 pgs).
Vimeo, "Cleaning Your YETI Hopper" uploaded by user YETI Coolers on Nov. 4, 2014, Accessed Sep. 27, 2017 (https://vimeo.com/11 0890075).
Youtube, "YETI Hopper Cooler at Icast 2014", Uploaded by user TackleDirect on Jul. 17, 2014, Accessed Jan. 31, 2017. (https://www.youtube.com/watch?v=A2rKRdyZcZ4).
YouTube-com: Patagonia Black Hole Duffel 60L. Published Aug. 26, 2013. Retrieved from the internet at <https://www.youtube.com/watch?v=W-PWEmZmVv8>, Dec. 19, 2016. 1 page.
Feb. 4, 2019—(AU) Examination Report—App. No. 2017263566.
Jul. 3, 2019—(CN) First Office Action—App. No. 201780042659.5.
Jun. 5, 2019—(AU) Notice of Acceptance for Patent Application—App 2017263566.
Oct. 2, 2019—(CN) Examiner's Report—App. No. 2017032351.
Jun. 3, 2019—(CN) First Office Action—App. No. 201680076714.8.
amazon.com, "E-MANIS Insulated Lunch Bag Adult Lunch Box Collapsible Multi-Layers Thermal Insulated Oxford Lunch Tote Cooler Bag for Men, women (grey)," visited May 7, 2019 at <https://www.amazon.com/MANIS-Insulated-Portable-Cooler-School/dp/B07BMT6948/ref=sr_1_23?keywords=soft+sided+cooler+lunch+box&qid=1557170800&s=home-garden&sr=1-23>.
amazon.com, "ZUZURO Lunch Bag Insulated Cooler Lunch Box w/ 3 Compartment—Heavy-Duty Fabric, Strong SBS Zippers—Includes 3 Meal Prep Lunch box Containers + 2 Ice Packs. For Men Women Adults (Black)," visited May 7, 2019 at <https://www.amazon.com/Zuzuro-Lunch-Insulated-Cooler-Compartment/dp/B079DZ2L1F/ref=sr_1_14?keywords=lunch+box+lid+ice+pack&qid=1557245496&s=gateway&sr=8-14>.
amazon.com, "Srotek Lunch Bag Insulated Lunch Box Tote Bag Cooler Bag Water-resistant Cute Lunch Bag Wide-open Thermal Tote Kit for Women/Girls/Work/Picnic, Grey Flamingo," visited May 7, 2019 at <https://www.amazon.com/dp/B07N57JSJS/ref=sspa_dk_detail_9?psc=1&pd_rd_i=B07N57JSJS>.
amazon.com, "MIER Insulated Double Casserole Carrier Thermal Lunch Tote for Potluck Parties, Picnic, Beach—Fits 9"×13" Casserole Dish, Expandable, Orange," visited May 7, 2019 at <https://www.amazon.com/MIER-Insulated-Casserole-Carrier-Thermal/dp/B01N0PW119/>.
amazon.com, "Lifewit Insulated Casserole Dish Carrier Thermal Lasagna Lugger for Potluck Parties/Picnic/Beach, Lunch Bag to Keep Food Hot/Cold, 16.3×12.6×4.7", Grey," visited May 7, 2019 at <https://www.amazon.com/dp/B07BFWJPV5/ref=sspa_dk_detail_6?psc=1&pd_rd_i=B07BFWJPV5&pd_rd_w=tr7Ke&pf_rd_p=46cdcfa7-b302-4268-b799-8f7d8cb5008b&pd_rd_wg=jq3TO&pf_rd_r=W7MFCBJR9DR0HV3AKZZB&pd_rd_r=604844a0-70d3-11e9-ad99-d763d3fc76f8>.
amazon.com, "Arctic Zone 2008IL515B42 Thermal Insulated Hot/Cold Food Carrier, Green," visited May 7, 2019 at <https://www.amazon.com/dp/B077T7FZBX/ref=sspa_dk_detail_0?psc=1&pd_rd_i=B077T7FZBX>.
amazon.com, "Lille 22oz Stainless Steel Leakproof Lunch Box, Insulated Bento Boxes | Thermal Food Container with Insulated Lunch Bag for Work | 2nd Gen with Durable Handle and Lid | BPA free | Adult, Women, Kid," visited May 7, 2019 at <https://www.amazon.com/Lille-Stainless-Leakproof-Insulated-Container/dp/B07HDTMJ7M/>.
Dec. 13, 2019—(CN) First Office Action—App. No. 201780020473.
United States District Court Western District of Texas, Austin Division, "Complaint for Damages and Injunctive Relief," *YETI Coolers, LLC* v. *Olympia Tools International, Inc.* d/b/a Coho Outdoors, Case 1:19-cv-00912, Document 1, Filed Sep. 16, 2019, 235 pages.
United States District Court Western District of Texas, Austin Division, "Defendant Olympia Tools International, Inc. d/b/a Coho Outdoors' Answer and Counterclaims to Plaintiff's Original Complaint," *YETI Coolers, LLC* v. *Olympia Tools International, Inc.* d/b/a Coho Outdoors, Case 1:19-cv-00912, filed Dec. 18, 2019, 48 pages.
Translation of FR 1269009A, Jackson, Jr., Jun. 26, 1961, p. 1, Fig. 2 (Year: 1961).
Jul. 22, 2022—(CN) Third Office Action—App. No. 201880070523.X.
Jul. 27, 2022—(MX) First Office Action—App. No. MX/a/2018/013890.
Sep. 20, 2022—(EP) Second Office Action—App. No. 18830667.4.
United States District Court Middle District of Florida, Tampa Division, "Complaint for Damages and Injunctive Relief, and Demand for a Jury Trial", *YETI Coolers, LLC* v. *Bote, LLC*, Case 8:23-cv-00370, Document 1, filed Feb. 17, 2023, 125 pages.
Nov. 24, 2022—(CN) Fourth Office Action—App. No. 201880035443.0.
Jan. 25, 2023—(JP) Office Action—App. No. 2020531697.
Jan. 20, 2023—(CN) Office Action No. 1—App. No. 202111319865.0.
Jan. 20, 2023—(MX) Office Action—App. No. MX/a/2018/013890.
Dec. 6, 2022—(EP) Office Action—App. No. 18813247.6.
Nov. 1, 2022—(CN) Decision of Rejection—App. No. 201880070523X.
United States District Court Western District of Texas Waco Division, "YETI Coolers, LLC's Opposed Motion to Intervene", *Ice Rover, Inc.* v. *YETI Holdings, Inc. and YETI Coolers, LLC*, Case 6:22-cv-00801-ADA-DTG, Document 17, Jury Trial Demanded, filed Jan. 3, 2023, 286 pages.
United States District Court Middle District of Florida, Tampa Division, "Defendant's Answer and Affirmative Defenses to Plain-

(56) References Cited

OTHER PUBLICATIONS tiff's Complaint for Damages and Injunctive Relief (Doc. 1), and Defendant's Demand for a Jury Trial ", *YETI Coolers, LLC* v. *Bote, LLC*, Case 8:23-cv-00370-WFJ-MRM, Document 38, filed Apr. 20, 2023, 46 pages.
TIZIP MasterSeal Datasheet, <https://web.archive.org/web/20100808133756/http://www.tizip.com/pdf/Datasheet_MasterSeal.pdf,> retrieved on May 1, 2023, Dec. 2009, 2 pages.
TIZIP MasterSeal 10 Webpage, <https://web.archive.org/web/20100803012209/http://www.tizip.com/index.htm,> retrieved on May 2, 2023, 4 pages.
Jun. 27, 2023—(AU) Examination Report No. 1—App. No. 2020382555.
Jun. 16, 2023—(CN) Second Office Action—App. No. 202111319865.0.
Jun. 28, 2023—(CN) Board Decision—App. No. 201780020473.X.

* cited by examiner

CLOSURE SYSTEMS AND INSULATING DEVICES HAVING CLOSURE SYSTEMS

CROSS REFERENCE TO RELATED APPLICATIONS

This patent application is a divisional of U.S. patent application Ser. No. 15/733,107, filed May 7, 2018, entitled Closure Systems and Insulating Devices Having Closure Systems, which is the National Stage of International Application No. PCT/US2016/060135, filed Nov. 2, 2016, which claims the benefit of U.S. Provisional Patent Application No. 62/249,711, filed on Nov. 2, 2015. This Application is also related to U.S. application Ser. No. 14/479,607, filed on Sep. 8, 2014, titled "Insulating Container" which is now U.S. Pat. No. 9,139,352; U.S. application Ser. No. 14/831,641 filed on Aug. 20, 2015, titled "Insulating Container"; and U.S. Provisional Application No. 61/937,310, filed on Feb. 7, 2014, titled "Insulating Device." All of the above applications are incorporated herein fully by reference.

FIELD

The present disclosure relates generally to closure systems and insulated devices or containers having closure systems.

BACKGROUND

Closure systems exist to close two pieces or sides of material together. In some examples such closure systems open and close an aperture. Many containers, and particularly non-rigid containers composed of materials such as fabric or foams, often include closure systems such as zippers. The closure system may be opened, allowing access to the interior of the closure, or closed, to seal the aperture.

SUMMARY

This Summary provides an introduction to some general concepts relating to this invention in a simplified form that are further described below in the Detailed Description. This Summary is not intended to identify key features or essential features of the invention.

Aspects of the disclosure herein may relate to closure systems including waterproof closure systems, durable closure systems, insulated closure systems, serviceable closure systems, locking closure systems, and flexible closure systems. Additionally, aspects of this disclosure relate to containers, such as insulated containers and coolers, have such closure systems. Additional aspects of this invention are described in greater detail below.

In one example, this disclosure provides a closure system. The closure system may include a first flange having a first end, a second end and a first engagement mechanism disposed between the first end and the second end; a second flange having a first end, a second end and a second engagement mechanism disposed between the first end and the second end; the first engagement mechanism configured to engage the second engagement mechanism, and the closure system having an open position wherein first engagement mechanism is substantially disengaged from the second engagement mechanism and a closed position wherein the first engagement mechanism is substantially engaged with the second engagement mechanism; a slider configured to selectively engage the first engagement mechanism and the second mechanism when moved in a first direction and disengage the first engagement mechanism from the second engagement mechanism when moved in a second direction.

The closure system may be substantially watertight in the closed position. The closure system may be watertight up to 7 psi above atmospheric pressure or up to 2 psi to 14 psi above atmospheric pressure.

The first end and the second end of the closure system may comprise a flexible material. Each of the first engagement mechanism and the second engagement mechanism may also comprise a flexible material. The closure system may also include at least one resilient member engaged with the first flange and the second flange, wherein the at least one resilient member is configured to bias the closure system open.

Each of the first engagement mechanism and the second engagement mechanism may include a hollow portion. The hollow portion of each of the first engagement mechanism and the second engagement mechanism may be a vacuum. The hollow portion of each of the first engagement mechanism and the second engagement mechanism may be filled with a polymeric foam.

The closure system may also include a shroud configured to substantially cover the entire first engagement mechanism and the entire second engagement mechanism.

One or more parts of the first engagement mechanism may be configured to removably engage the first flange with at least one of: press fitting, snap fit mechanisms or mechanical fasteners, and one or more parts of the second engagement mechanism may be configured to removably engage the second flange with at least one of: press fitting, snap fit mechanisms or mechanical fasteners. The slider may also be configured to removably engage the first and second flange with at least one of: press fitting, snap fit mechanisms or mechanical fasteners.

The closure system may also include a closure indicator configured to indicate the closure system is in a fully closed position.

The first engagement mechanism and the second engagement mechanism may each comprise zipper teeth. The first engagement mechanism and the second engagement mechanism may each comprise a plurality of rails.

In another example this disclosure provides a container. The container may include an outer shell; an opening extending through the outer shell; and a closure system adapted to substantially seal the opening. The closure system may include a first flange engaged with the container, the first flange having a first end, a second end and a first engagement mechanism disposed between the first end and the second end; a second flange engaged with the container, the second flange having a first end, a second end and a second engagement mechanism disposed between the first end and the second end; the first engagement mechanism configured to engage the second engagement mechanism, and the closure system having an open position wherein first engagement mechanism is substantially disengaged from the second engagement mechanism and a closed position wherein the first engagement mechanism is substantially engaged with the second engagement mechanism; a slider configured to selectively engage the first engagement mechanism and the second mechanism when moved in a first direction and disengage the first engagement mechanism from the second engagement mechanism when moved in a second direction;

The closure system may be substantially watertight in the closed position. The closure system may be watertight up to 7 psi above atmospheric pressure.

Each of the first engagement mechanism and the second engagement mechanism may include a hollow portion. The hollow portion of each of the first engagement mechanism and the second engagement mechanism may be filled with a polymeric foam.

One or more parts of the first engagement mechanism may be configured to removably engage the first flange with at least one of: press fitting, snap fit mechanisms or mechanical fasteners, and wherein one or more parts of the second engagement mechanism may be configured to removably engage the second flange with at least one of: press fitting, snap fit mechanisms or mechanical fasteners. And the slider may be configured to removably engage the first and second flange with at least one of: press fitting, snap fit mechanisms or mechanical fasteners.

The container may also include a closure indicator configured to indicate the closure system is in a fully closed position.

The first engagement mechanism and the second engagement mechanism may each comprise zipper teeth. The first engagement mechanism and the second engagement mechanism may each comprise a plurality of rails.

In another example, this disclosure provides a closure system. The closure system may include, a first flange having a first end, a second end and a first engagement mechanism disposed between the first end and the second end; a second flange having a first end, a second end and a second engagement mechanism disposed between the first end and the second end; the first engagement mechanism configured to engage the second engagement mechanism, and the closure system having an open position wherein first engagement mechanism is substantially disengaged from the second engagement mechanism and a closed position wherein the first engagement mechanism is substantially engaged with the second engagement mechanism; a slider configured to selectively engage the first engagement mechanism and the second mechanism when moved in a first direction and disengage the first engagement mechanism from the second engagement mechanism when moved in a second direction.

The closure system may be substantially watertight in the closed position up to 7 psi above atmospheric pressure. The first engagement mechanism and the second engagement mechanism may each comprise a plurality of rails. Each of the first engagement mechanism and the second engagement mechanism may comprise a flexible material. Each of the first engagement mechanism and the second engagement mechanism include a hollow portion; and the hollow portion of each of the first engagement mechanism and the second engagement mechanism may be filled with a polymeric foam. One or more parts of the closure system may be configured to be removably engaged with at least one of: press fitting, snap fit mechanisms or mechanical fasteners.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Also, while the terms "frontside," "backside," "top," "base," "bottom," "side," "forward," and "rearward" and the like may be used in this specification to describe various example features and elements, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the claims.

Figure 1A:
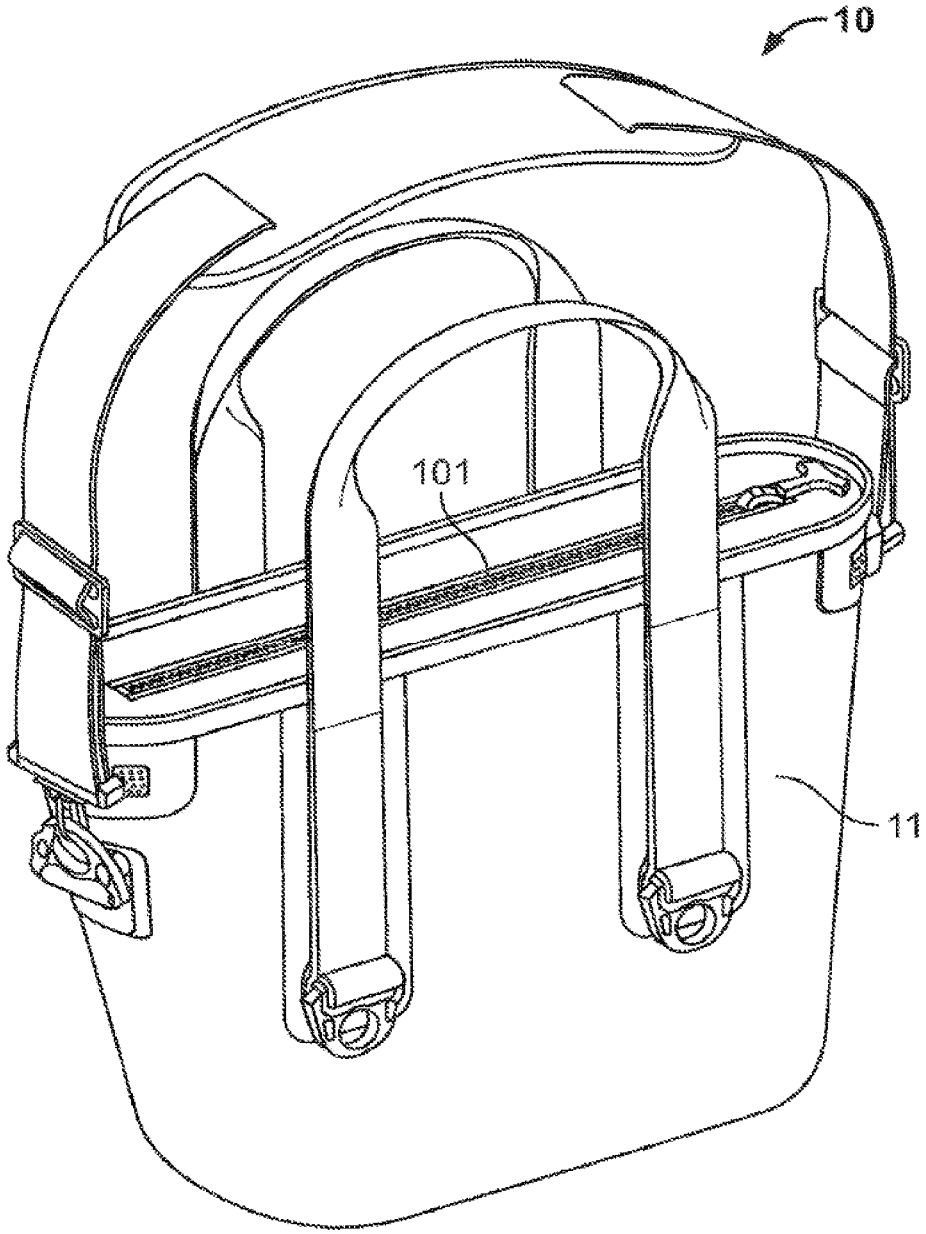
FIG. 1A shows a perspective view of a container having a closure system according to aspects of this disclosure.
Figure 1B:
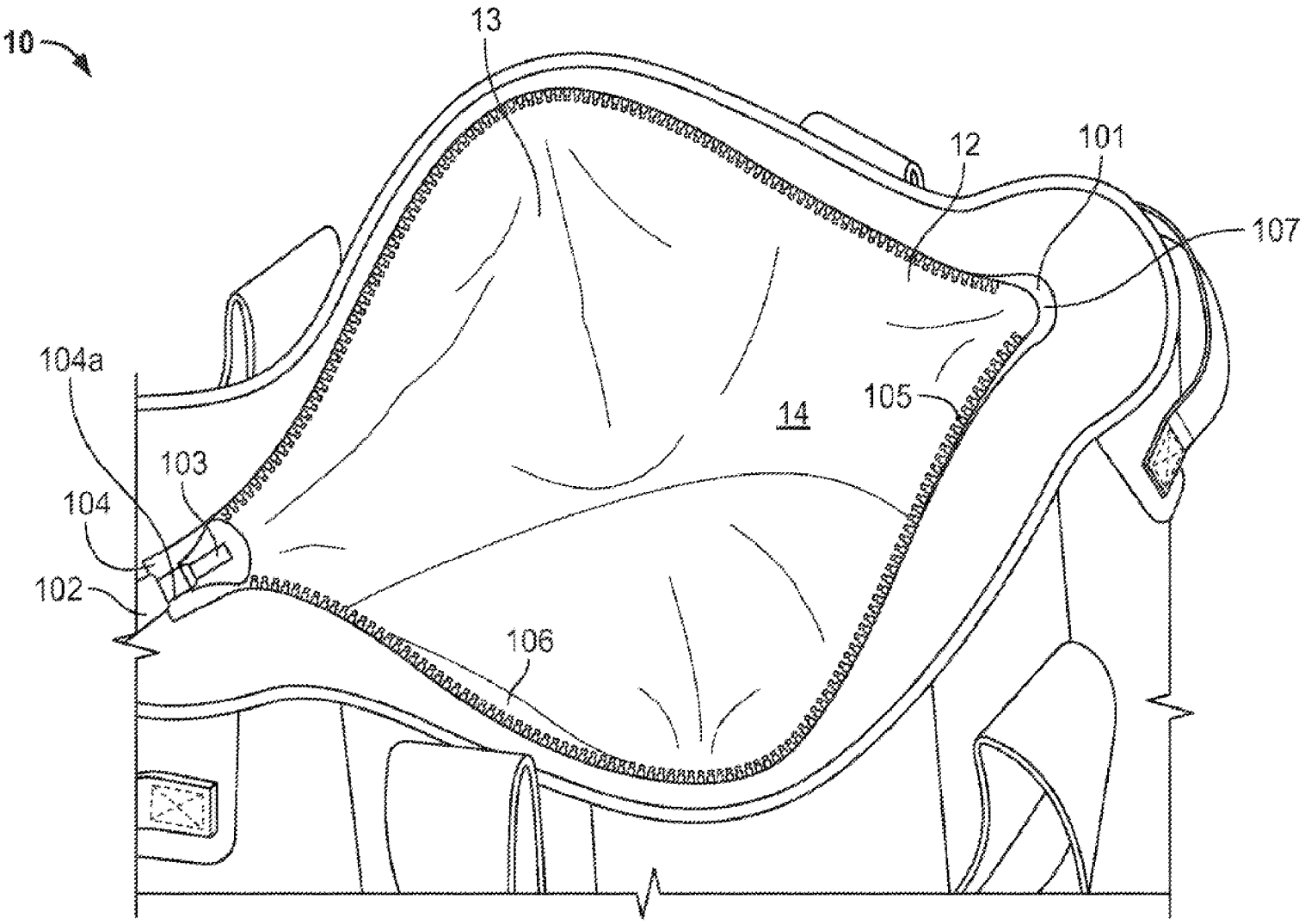
FIG. 1B shows a perspective view of a portion of a container having a closure system in an open position according to aspects of this disclosure.
Figure 1C:
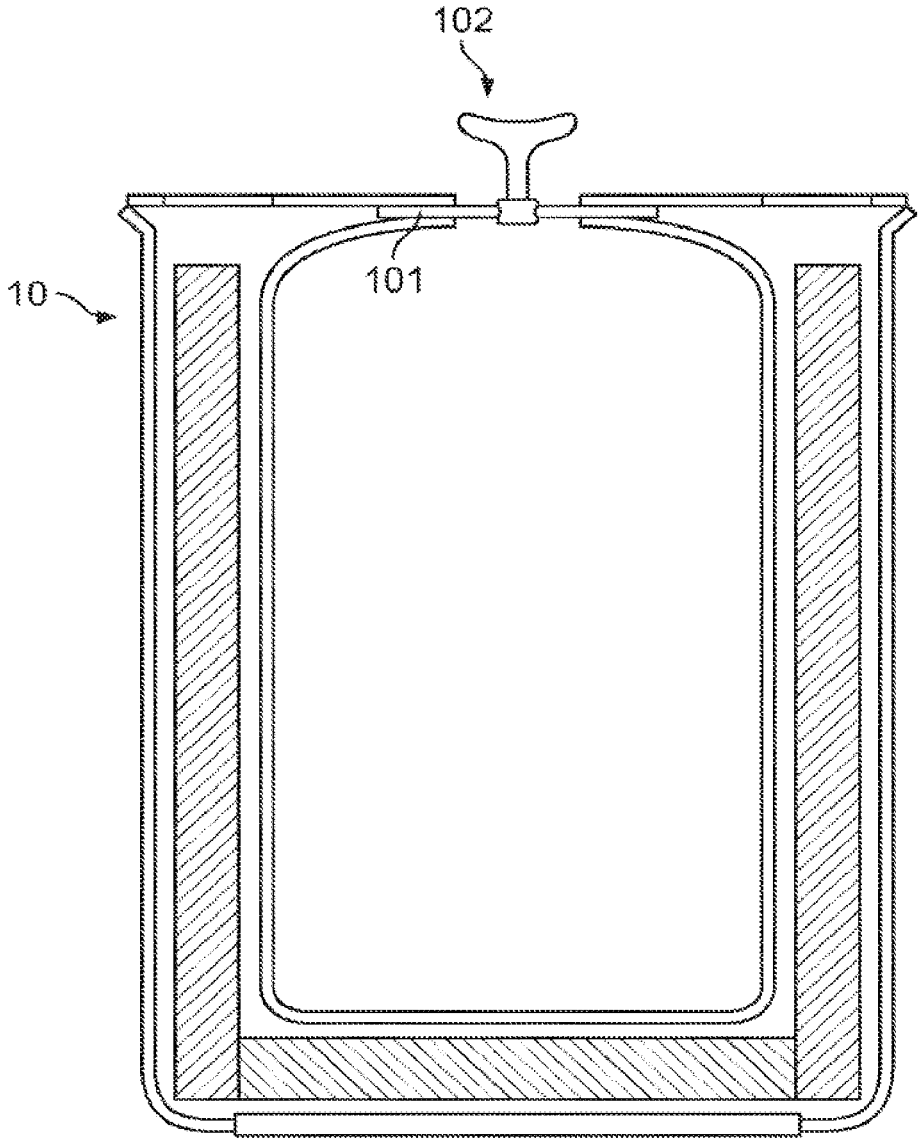
FIG. 1C shows a cross-sectional view of a container having a closure system according to aspects of this disclosure.

FIG. 1A-1C depict an exemplary container 10, such as an insulating device that may be configured to keep desired contents stored cool or warm for an extended period of time.

The container can generally include an outer shell 11, a closure 101, an insulating layer 12, and an inner liner 13. As shown in FIG. 1B, the inner liner 13 forms a chamber or receptacle 14 for receiving the desired contents therein. As shown in FIG. 1A, various handles, straps, and webs can also be included on the container 10 for carrying, holding, or securing the container.

In some embodiments, the container 10, may be an insulating device configured to keep desired contents stored in the receptacle 14 cool or warm for an extended period of time. In one example, the container 10 can also be designed to maintain water inside the inner chamber or receptacle 14, and the container 10 can be configured to be water "resistant" from the outside in. In other words, container 10 can be formed "water tight" inside the inner liner 13, and water cannot leak into the inner liner 13 from the outside or out from the inside of the inner liner 13 when the closure 101 is in the closed position. A cross-section of an exemplary container 10 is shown in FIG. 1C.

Figure 8:
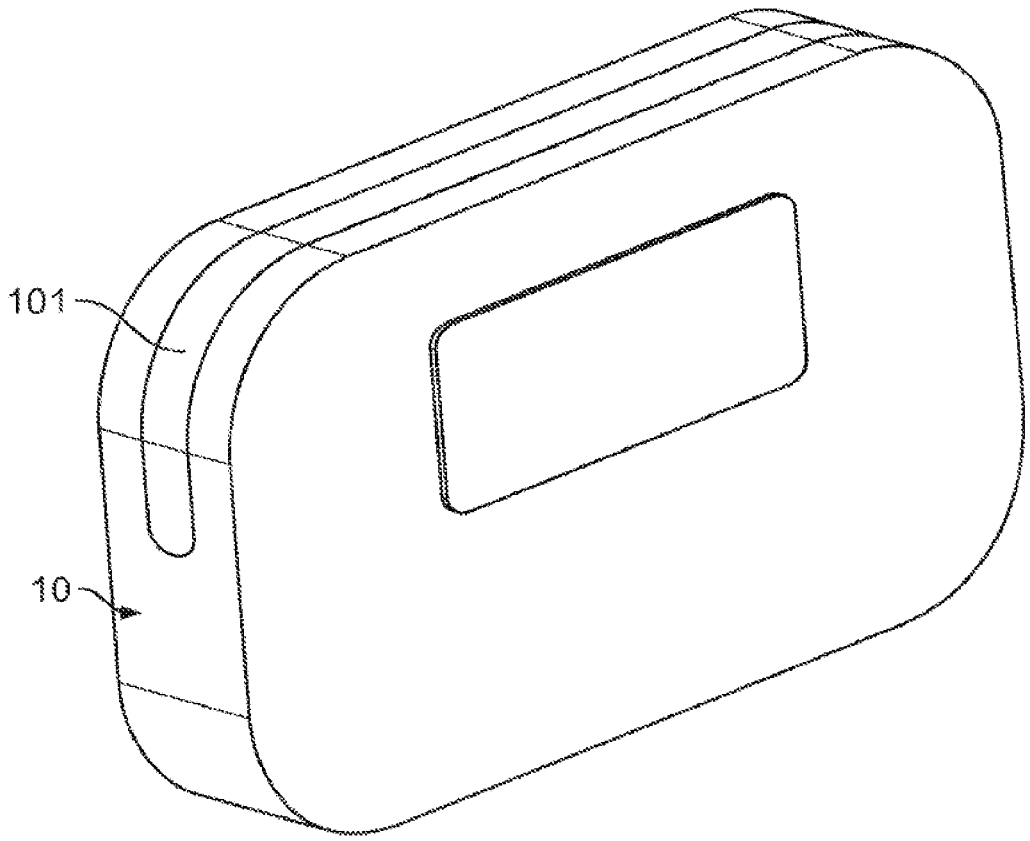
FIG. 8 shows a perspective view of a container having a closure system according to aspects of this disclosure.

In certain Figures herein the closure 101 is shown and described as attached to a container 10. The container 10 may be any suitable size and shape. For example, another exemplary container 10 is shown in FIG. 8 also having a closure 101. While the closures are primarily discussed with reference to a container 10, the closures described herein may be used with any suitable item including for example shirts, jackets, and other apparel items, tents and any other items which may require a closure.

In embodiments discussed herein the container 10 and particularly the closure 101 may have many characteristics. For example, the closure 101 may be safe such that it does not pose any safety concerns from a user's perspective. The closure 101 and container may be safe for the storage of food. The closure 101 and container 10 may be water tight such that water may not enter or exit the container 10 through the closure 101 when the closure 101 in a closed position, and in other embodiments container 10 may be air tight such that air may not enter or exit the container 10 through the closure 101 when the closure 101 in a closed position. Certain manufacturing methods such as radio frequency welding (RF welding) and other techniques described herein may be used to produce water and/or air tight seals. The closure 101 and the container 10 may be durable such that they rarely break or malfunction. The closure 101 and the container 10 may be serviceable such that if they do break or malfunction they may be fixed by a user. The closure 101 may have a smooth operation such that a user may easily open and close the closure 101. The closure 101 may be corrosion-resistant such that it does not contain parts that typically rust or oxidize in outdoor environments. The closure 101 may be abrasion-free such that a user does not experience hand abrasion during use of the closure 101. The closure 101 may also close in a way where the user knows for certain that the closure is 100% sealed. This may include an indicator and/or lock system to ensure the closure is in a fully closed position.

In embodiments, the closure 101 may be customizable or formable such that it may form various shapes including, for example, a U-shape and a shape configured on the perimeter of a container 10, or partial perimeter of a container 10 as shown in FIG. 8. The closure 101 may have a smooth operation and may be lubricant-free such that it does not require lubricant before, during, or after use. For example, the materials used for the closure 101 may include self-lubricating materials or materials that have low friction. Such materials may include certain polymers, polymers that may include certain additives to reduce friction, low friction polymers, thermoplastic polyurethane, and Polytetrafluoroethylene (PTFE). In other examples, the closure 101 may include a coating such as a lubricating paint that may reduce the friction from operation of the closure 101. Additionally, in some examples, the specific shape of the teeth may assist in making the operation of the closure 101 smoother.

The closure 101 and the container may be delamination-free such that any laminated or bonded materials, fabrics, or coatings do not separate. The closure 101 and container 10 may be ultraviolet radiation resistant such that ultraviolet degradation does not occur or is limited when the closure 101 and/or container are exposed to ultraviolet radiation such as sunlight. The closure 101 and/or container may have multiple different color options. The closure 101 and/or container may be sand-proof such that the closure 101 still functions if exposed to sand and/or soil. The container 10 and/or closure 101 may be chemical resistant such that no degradation or limited degradation occurs when the container 10 and/or closure 101 are exposed to chemicals such as soaps, sunscreens, bug sprays, etc. The closure 101 may also provide insulating properties which may prevent the closure 101 and/or container 10 from sweating. The closure 101 and/or container 10 may be flexible such that the closure 101 may be able to bias open and bias closed. Additionally, the closure 101 and/or container 10 may be easy to assemble into a finished product, for example, the closure 101 may include a slider pull which can be attached before or after assembly.

Referring now more particularly to the closure 101, in one example, the closure 101 can be substantially waterproof or a barrier to prevent liquid contents from either entering or exiting through the closure 101. In some embodiments, maintaining the closure 101 in a flat plane can assist in providing a water tight seal, however, in other embodiments the closure 101 can have any shape and maintain a water tight seal. In one example, the closure 101 can be a can be watertight up to 7 psi above atmospheric pressure during testing with compressed air. However, in other examples, the water tightness of the closure 101 can be from 5 psi to 9 psi above atmospheric pressure and in other examples, the water tightness of the closure 101 can be from 2 psi to 14 psi above atmospheric pressure, and in still other examples the water tightness of the closure 101 can be from 1 psi to 15 psi above atmospheric pressure.

Figure 1D:
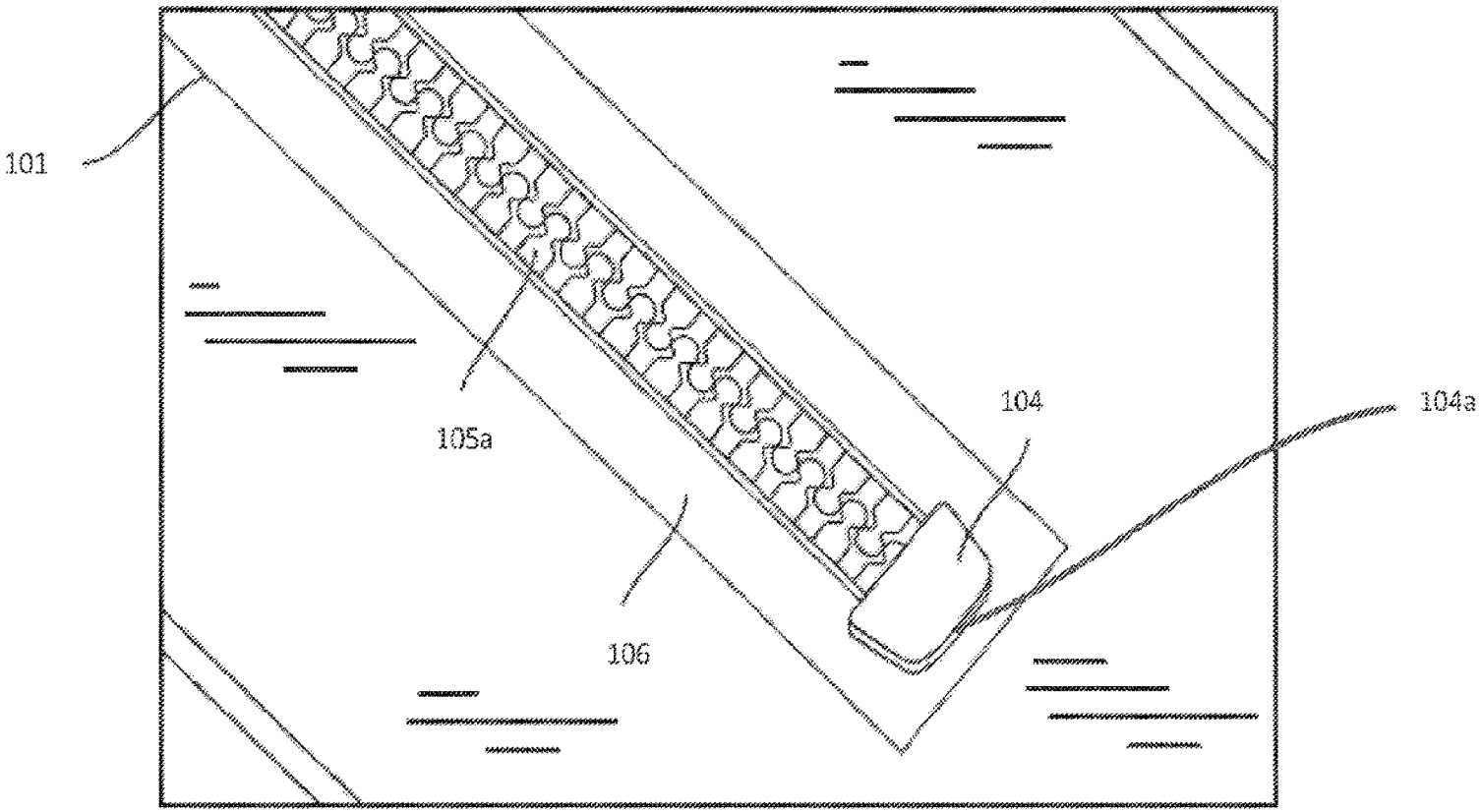
FIG. 1D shows a top view of a portion of a container having a closure system according to aspects of this disclosure.
Figure 1E:
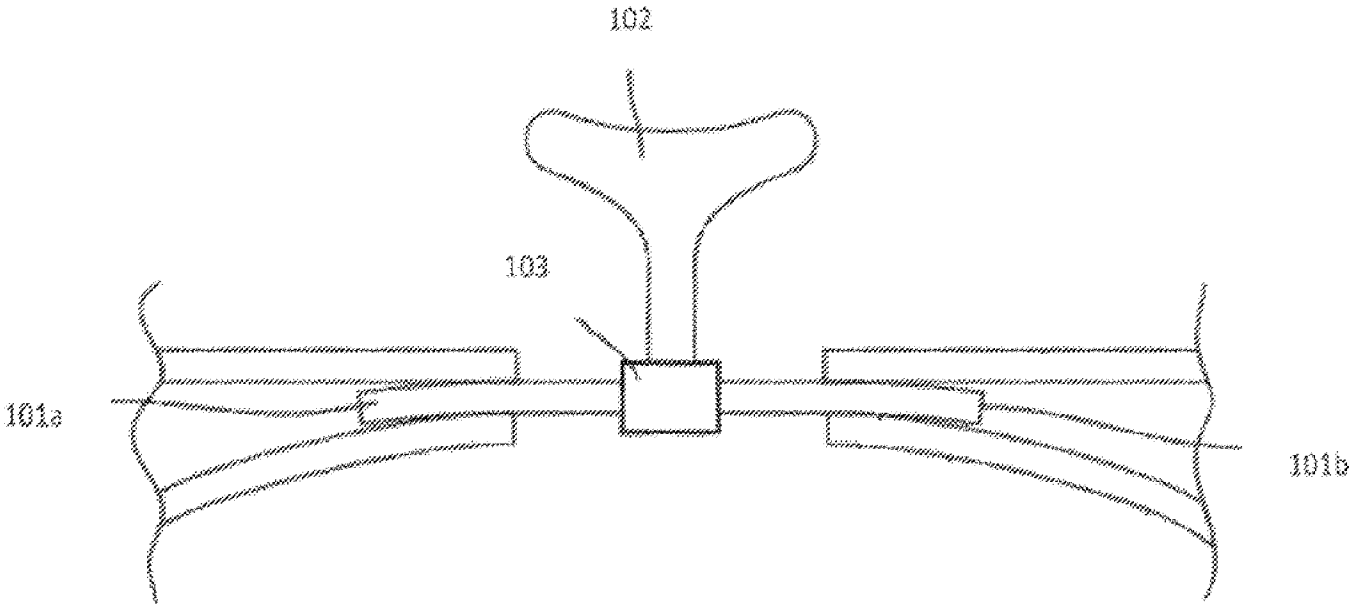
FIG. 1E shows a cross-sectional view of a portion of a container having a closure system according to aspects of this disclosure.
Figure 2A:
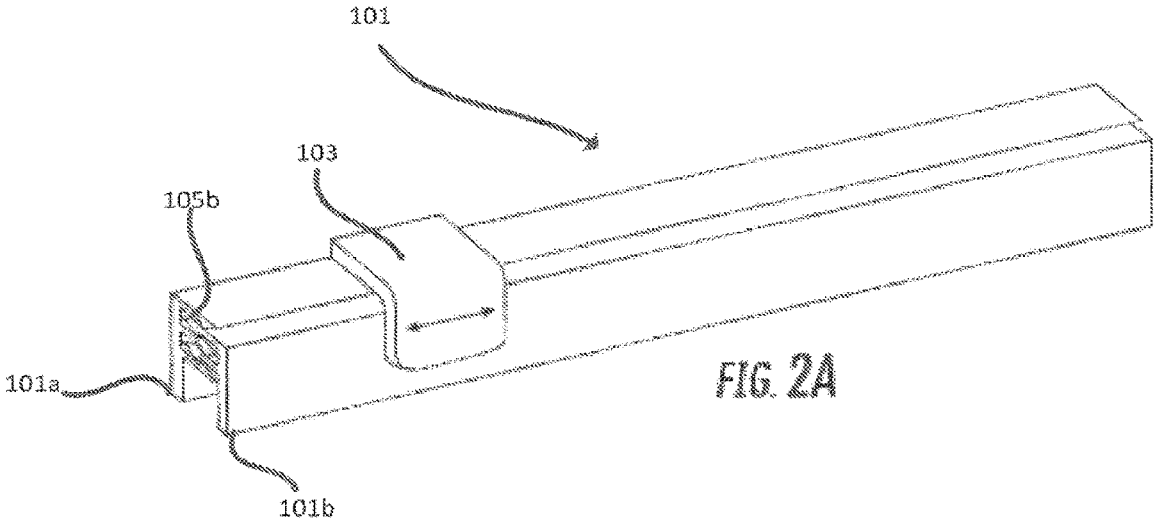
FIG. 2A shows a perspective view of a closure system having a plurality of rails.
Figure 2B:
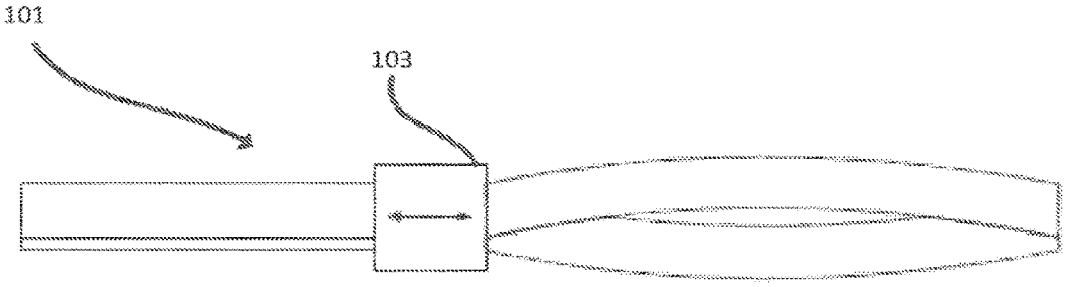
FIG. 2B shows a top view of the closure system of FIG. 2A.
Figure 2C:
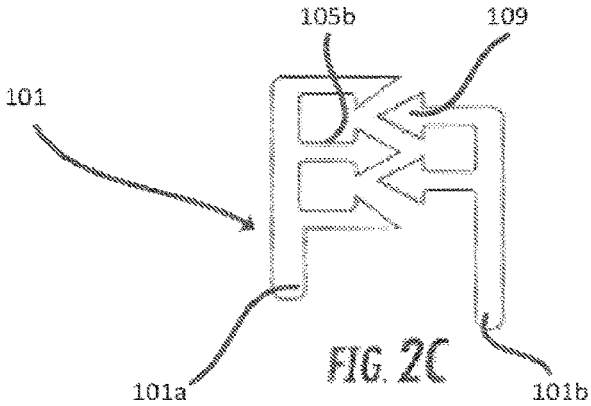
FIG. 2C shows a front view of the closure system of FIG. 2A.

As shown primarily in FIGS. 1B, 1D and 1E, the closure assembly 101 can be a waterproof zipper assembly which can include a slider body 103 which may include a pull-tab 102. FIG. 1D shows a magnified view of the closure 101 that includes a bottom stop 104 at a bottom end 104*a* of the closure. FIG. 1B shows the top end 107 of the closure 101. As shown in FIGS. 1A-1E, the closure 101 may include teeth or a chain 105. In one particular example, the waterproof zipper assembly can be constructed with plastic or other non-metallic teeth 105*a* and in other examples the teeth 105*a* may be metallic. In other examples, the closure may seal without using teeth or chain and may include different engagement mechanisms 105. For example, the closure 101 may include a zip lock type sealing mechanism comprising a plurality of rails as shown in FIGS. 2A-2C and as will be described in more detail below.

Figure 3:
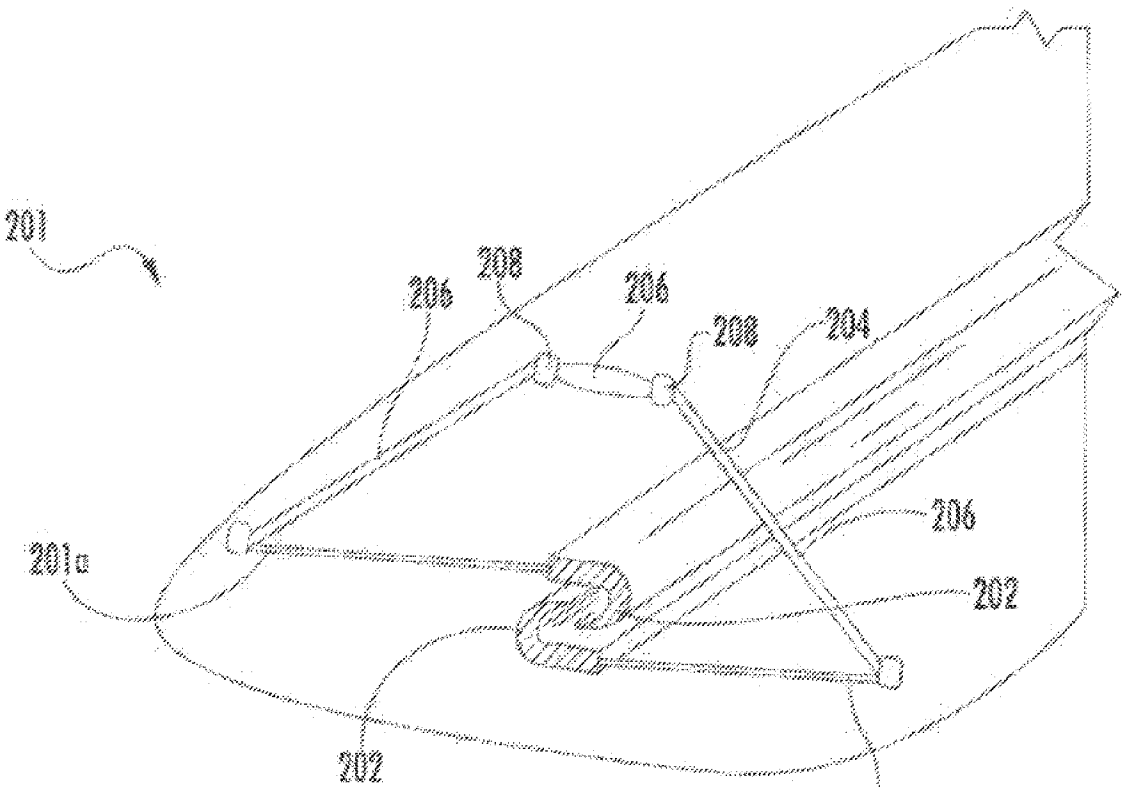
FIG. 3 shows a partial view of another embodiment of a closure system according to aspects of this disclosure.

In another example, as shown in a cross-sectional view in FIG. 3, the closure 201 can include interlocking portions 202 that when pulled together create a watertight seal as described above. The closure 201 shown in FIG. 3 may also include a tightening device 204. The tightening device 204 may include two or more linkages 206 including one or more pivot points 208. The linkages may also be connected to flanges 201*a* and 201*b* which are connected to the interlocking portions 202. As shown in FIG. 3, the linkages may be pushed down causing the linkages 204 to straighten which causes the interlocking portions 202 to pull together which may create a watertight and/or airtight seal.

Returning now to FIGS. 1A-1E, as shown schematically, primarily in FIG. 1E, the closure 101 can be provided with a first flange 101*a* and a second flange 101*b*, which can in some embodiments form waterproof zipper tape. In some embodiments, and as shown in FIG. 1E, the closure 101 can be attached directly to the container 10 using the first flange 101*a* and the second flange 101*b* of the closure 101. In one example, the first flange 101*a* and the second flange 101*b*, can be RF welded to the container 10. In other embodiments, the container 10 can be attached to the closure 101 by polymer welding or adhesive. Polymer welding includes both external and internal methods. External or thermal methods can include hot gas welding, hot wedge welding, hot plate welding, infrared welding and laser welding. Internal methods may include mechanical and electromagnetical welds. Mechanical methods may include spine welding, stir welding, vibration welding, and ultrasonic welding. Electromagnetical methods may include resistance, implant, electrofusion welding, induction welding, dielectric welding, RF (Radio Frequency) welding, and microwave welding. The welding can be conducted in a flat or horizontal plane or in other three dimensional shapes. As a result, a rugged watertight seam can be created that prevents water or fluids from escaping from or into the inner chamber 14 of the container 10.

The connection between the closure 101 and the container 10 prevents water or any other fluid from penetrating the seam at pressure up to 7 psi above atmospheric pressure. The container 10, therefore, can be inverted or submerged in water and leakage is prevented both into and out of the internal chamber 104. In one example, the container 10 can be submerged under water to a depth of about 16 feet before water leakage occurs. However, this depth could range from about 11 feet to 21 feet or 5 feet to 32 feet before any leakage occurs.

As discussed above, the closure 101 may be constructed in such a way that it is delamination-free such that any laminated or bonded materials, fabrics, or coatings of the closure 101 do not separate. For example, the closure teeth 105*a* or other engagement mechanism may be assembled to the respective flanges 101*a* and 101*b* in such a way that the teeth 105*a* or other engagement mechanism are restrained from separating from the flanges 101*a* and 101*b*. Advantageously, such constructions methods may allow for increased water resistance of the closure.

In one example, the teeth 105*a* or other engagement mechanism and the flanges 101*a* and 101*b* may be made of weldable material such as certain types of thermoplastic polyurethane. The teeth 105*a* or other engagement mechanism and the respective flanges 101*a* and 101*b* may be welded together forming a bond between the teeth 105*a* or other engagement mechanism and the respective flanges 101*a* and 101*b*. This bond may be watertight and/or airtight as described above.

In another example, the teeth 105*a* or other engagement mechanism may be integrally formed with the respective flange 101*a* and 101*b*. In some embodiments, the teeth 105*a* or other engagement mechanism may be injection molded as an integral piece with the respective flange 101*a* or 101*b*. In such an embodiment, the teeth 105*a* or other engagement mechanism and the flanges 101*a* and 101*b* may be made of a thermoplastic polymer or other suitable material.

As briefly described above, in another example and as shown in FIGS. 2A-2C, the engagement mechanism 105 can comprise a plurality of rails 105*b*. Similar to the embodiment shown in FIGS. 1A-1E, the closure 101 can be provided with a first flange 101*a* and a second flange 101*b*, which can in some embodiments form waterproof zipper tape. Each flange 101*a* and 101*b* can include a plurality of rails 105*b*. As shown in FIG. 2C, the first flange 101*a* may have three rails and the second flange 101*b* may have two rails, however, any number of rails 105*b* may be used. Additionally, as shown in FIG. 2C, one or more of the rails may include a barb 109 which may assist in creating a seal between the two flanges 101*a* and 101*b*.

As described above, the rails 105*b* may be integrally formed with the respective flange 101*a* and 101*b*. In some embodiments, the rails 105*b* or other engagement mechanism may be injection molded as an integral piece with the respective flange 101*a* or 101*b*. In such an embodiment, the rails 105*b* or other engagement mechanism and the flanges 101*a* and 101*b* may be made of a thermoplastic polymer or other suitable material.

The closure 101 shown in FIGS. 2A-2C may also include a slider 103. The slider may be configured to selectively engage the first engagement mechanism and the second mechanism when moved in a first direction and disengage the first engagement mechanism from the second engagement mechanism when moved in a second direction. As described in more detail below the slider 103 and other portions of the closure 101 may be removably engaged.

Closure embodiments described herein are not limited to a straight closure 101 as shown for example in FIG. 1A. For example, in some embodiments the teeth 105*a*, rails 105*b*, or other engagement mechanism and flange elements 101*a* and 101*b* may be molded into a semi-circular shape, three sides of a rectangular shape, a shape which follows a perimeter a the container or any other suitable shape. Furthermore, in certain embodiments, the teeth 105*a*, rails 105*b*, or other engagement mechanism need not be uniform as in a typical zipper. For example, in some embodiments, it may be advantageous for a single closure 101 to have teeth 105*a* having different sizes. This may be helpful, for example, where the closure turns a corner.

In still other embodiments, the teeth 105*a*, rails 105*b*, or other engagement mechanism and both flange elements 101*a* and 101*b* can be molded in a single integral piece. Such a configuration may provide a tight seal in the closure. In such a configuration, a removable slider, as discussed in more detail below, may be placed on the teeth to complete the closure.

In still another example, the teeth 105*a*, rails 105*b* or other engagement mechanism and the respective flanges 101*a* and 101*b* may be integrally formed using an extrusion process. In such an embodiment, the flange and teeth portion may first be extruded using standard extrusion techniques. In one example, after the extruded piece exits the extrusion machine, the teeth 105*a* may be stamped or cut using a die or other similar device.

Figure 4:
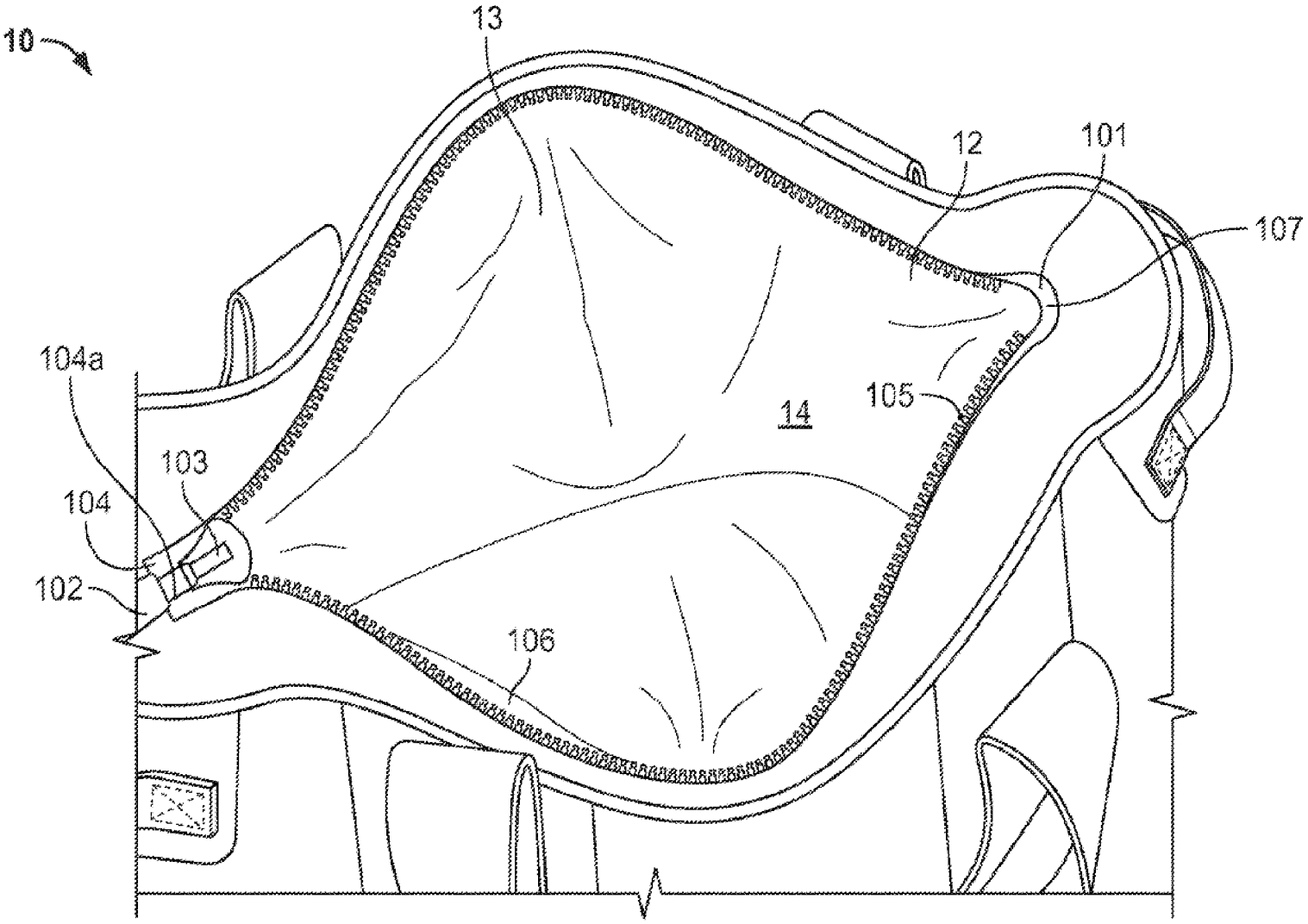
FIG. 4 shows a perspective view of a portion of a container having a closure system in an open position according to aspects of this disclosure.

As discussed above, the closure 101 and/or container 10 may be flexible such that the closure 101 may be able to bias open and bias closed. As shown for example in FIG. 4, a container having a closure 101 is shown in an open position. In some embodiments, the closure 101 may include elements which allow the closure to bias open. For example, in some embodiments, the closure 101 at the bottom end 104*a* and the top end 107 may be made of a flexible material. In some embodiments, this flexible material may be the same or different than the material used to make the flanges 101*a* and 101*b*. In some embodiments this may allow the closure 101 to open at the ends 104*a* and 107 to an angle of at least 45 degrees and may remain in an open position.

In other embodiments the closure 101 may include a spring or other resilient member that may bias the closure open. In some embodiments the spring or other resilient member may be located at the ends 104*a* and 107 to bias the closure 101 open. In still other embodiments, a spring or resilient member may be located on the container 10 to bias the closure open when the closure 101 is unzipped.

In still other embodiments, certain parts of the closure 101 including the teeth 105*a* and/or flanges 101*a* and 101*b* may be manufactured of flexible or stretchable material. Advantageously this may allow the closure to deform while staying sealed. Additionally, this may allow for the closure to be shaped in any different shapes as described above.

In some embodiments, as described above, the closure 101 and/or container 10 may provide insulating properties which may prevent the closure 101 and/or container 10 from sweating. In some embodiments, the closure 101, or portions of the closure 101 including the teeth 105*a*, rails 105*b*, or other engagement mechanism and/or flanges 101*a* and 101*b*, may include materials or additives that may increase the insulative properties of the closure 101.

Figure 5A:
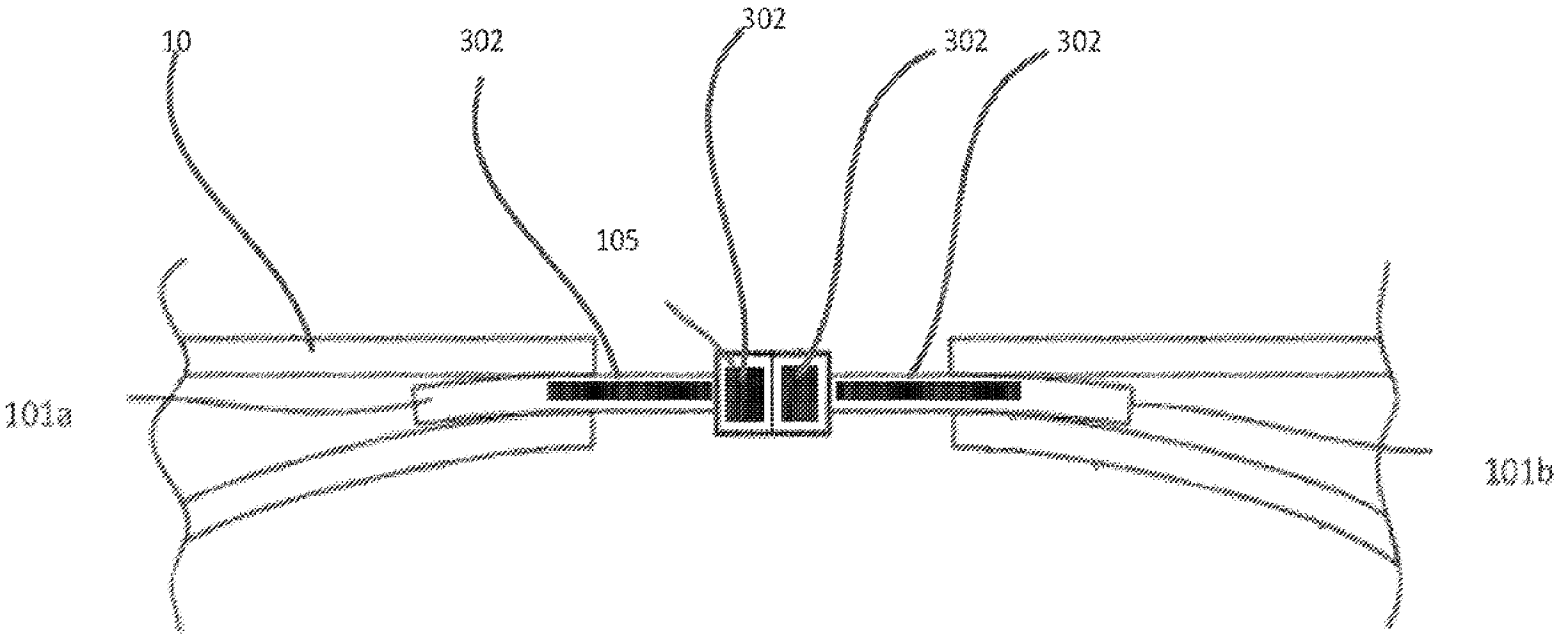
FIG. 5A shows a cross-sectional view of a portion of a container having a closure system according to aspects of this disclosure.
Figure 5B:
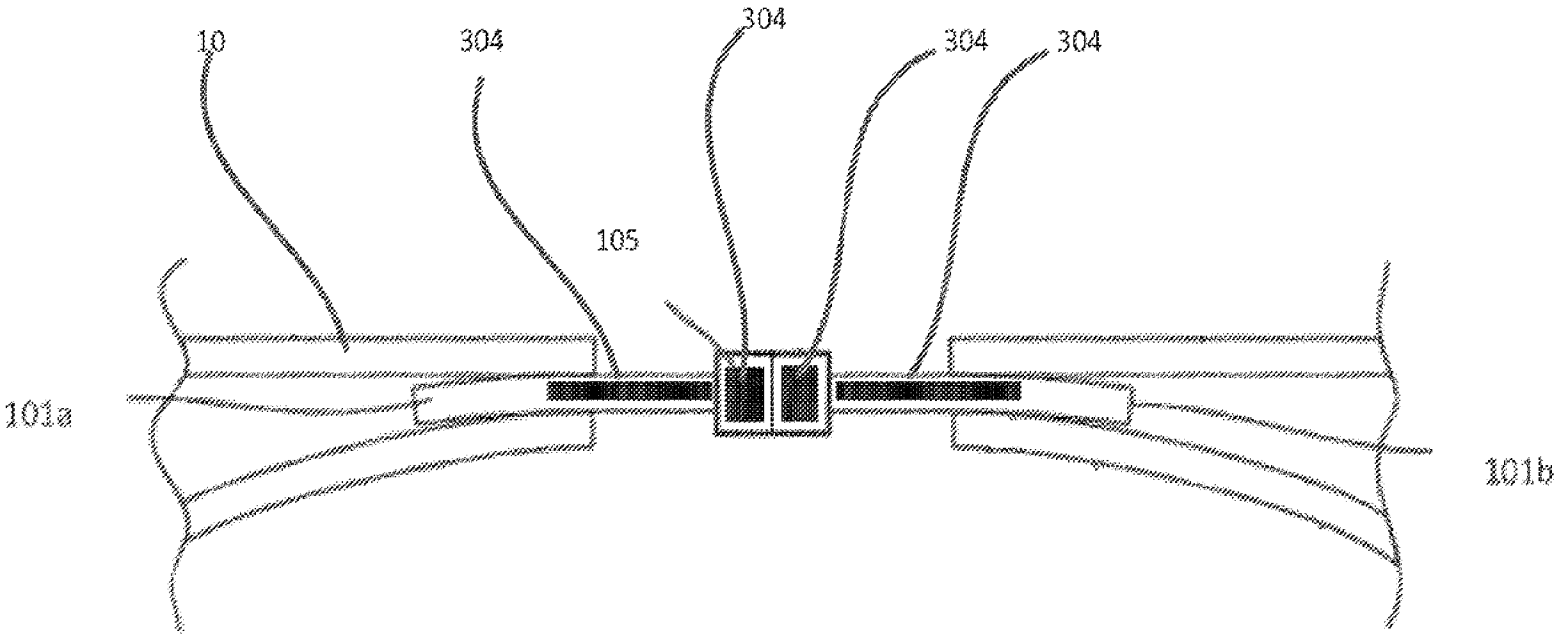
FIG. 5B shows a cross-sectional view of a portion of a container having a closure system according to aspects of this disclosure.

In some embodiments, as shown for example in FIG. 5A, the closure 101 (including the teeth 105*a*, rails 105*b*, or other engagement mechanism and flanges 101*a* and 101*b*) may include portions 302 which are filled with a polymeric foam, such as a polyurethane foam which may increase the insulative properties of the closure 101. In other embodiments, as shown for example in FIG. 5B, the closure 101 or portions of the closure 101, including the teeth 105*a*, rails 105*b*, or other engagement mechanism and the flanges 101*a* and 101*b*, may be formed with internal hollow areas 304. In some embodiments, the hollow areas 304 may include a core reinforcing structure and/or may be in a vacuum which may also increase the insulative properties of the closure.

In still other embodiments, the closure 101 or portions of the closure 101, including the teeth 105*a*, rails 105*b*, or other engagement mechanism and the flanges 101*a* and 101*b*, may be formed with additives that may increase the insulative properties of the closure 101. These additives may include vacuum insulated micro-spheres, micro-spheres, and foaming agents.

Figure 5C:
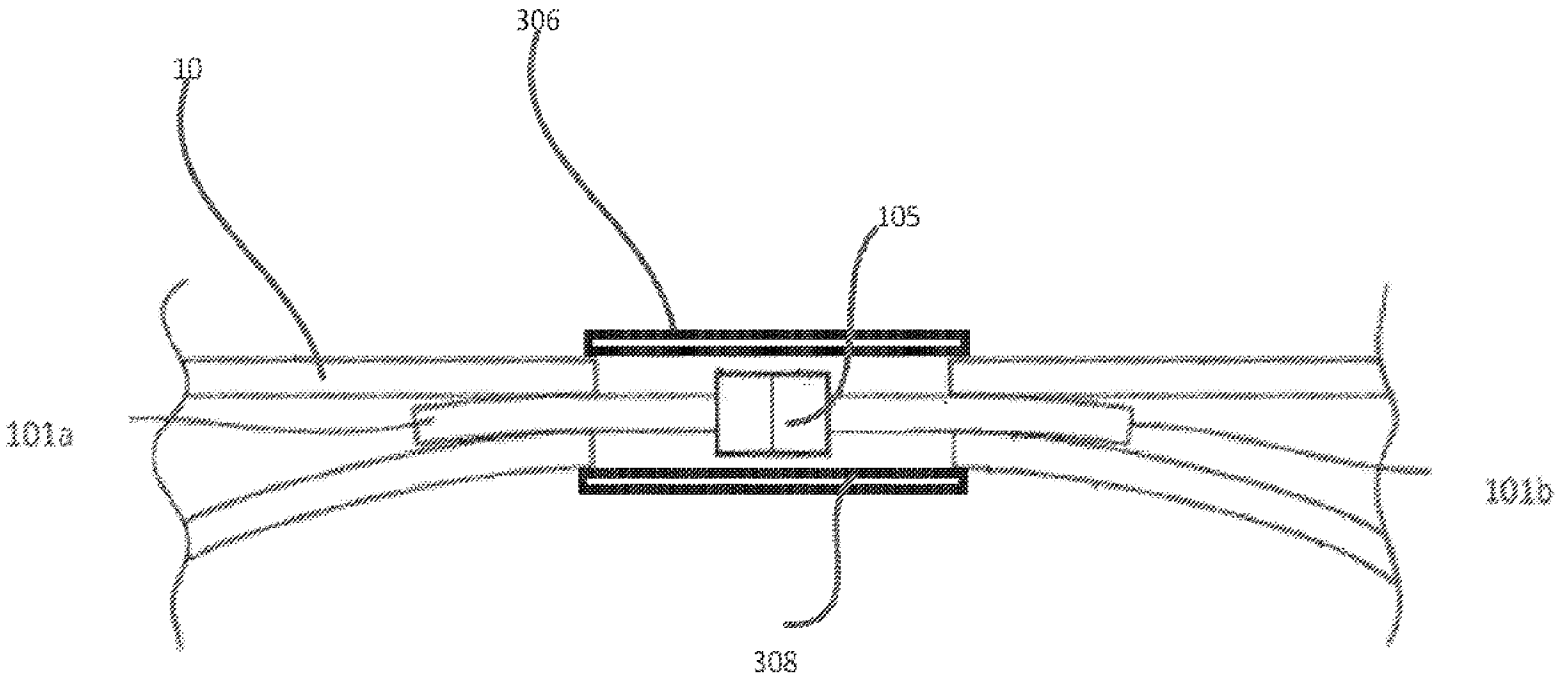
FIG. 5C shows a cross-sectional view of a portion of a container having a closure system according to aspects of this disclosure.

In still other examples, as shown in FIG. 5C, the closure 101 may include a shroud or cover on the inside 308 and/or outside 306 of the closure 101. The shroud may cover portions or all of the closure 101 to provide additional insulation. The shroud 306, 308 may be attached on one side to the container 10 or to the flange 101*a*, 101*b*. In some examples the shroud may be made of neoprene or another similar material.

FIGS. 6A-6D depict another example zipper assembly 400 which may be used with embodiments of the closure 101 described above. In this example, the zipper 401 and its components can be configured to be modular or replaceable. In certain situations, one or more components of the zipper 401 can fail for various reasons during the life of the zipper 401. For example, one or more of the zipper teeth 405, the slider body 403, the pull tab 402, the zipper tape 406, the docking station 408, or the bottom stop 404 can each fail during the life of the zipper 401. Nevertheless, this can compromise the entire insulated device, for example, and render it non-functional for its intended purpose and may require the entire insulated device to be replaced in its entirety due to the failure of the closure device. In the example shown in FIGS. 6A-6D, 400, each of the zipper teeth 405, the slider body 403, the pull tab 402, zipper tape 406, the docking station 408, and the bottom stop 404 can be configured to be replaceable in the case that one or more of these components fail or no longer operate properly.

In one example, each one of the zipper teeth 405 can be configured to be individually replaceable. In a specific example, each of the zipper teeth 405 could be removably fastened to the zipper tape 406. For example, although not shown, the zipper teeth 405 can be secured to the zipper tape 406 by one or more of threads, interference fits, ball and socket connections, or bayonet-type connections.

For example, in the case of a threaded connection, each tooth 405 can include one or more threads and the zipper tape 406 can include a threaded socket for receiving the threads of the teeth. It is also contemplated that each tooth 405 can be provided with a threaded socket for receiving external threads on the zipper tape 406. In this example, to replace a particular tooth 405 that is chipped or no longer working, the user can simply unscrew the tooth 405 from the zipper tape 406 and screw in a new tooth to replace the broken or malfunctioning tooth.

In another example, an interference fit may be implemented, where each of the ends of the zipper teeth could be sized larger than corresponding slots or holes in the zipper tape 406. In an alternative example, each tooth 405 could be provided with a detent, which can be received in a corresponding slot in the zipper tape 406. The detent could be formed larger than the corresponding socket in the zipper tape 406, such that the teeth are securely held into place on the zipper tape. Alternatively, the detents could be placed on the zipper tape, such that corresponding slots or holes on each tooth can receive the detents of the zipper tape. In another alternative example, each tooth of the zipper teeth 405 could be provided with a pin or slot and the zipper tape could be provided with corresponding pins or slots for receiving the zipper teeth 405. Additionally, each tooth of the zipper tape 405 could be provided with a ball end or socket end and the zipper tape could include corresponding balls or sockets for receiving each of the zipper teeth 405. Including a bayonet-type connection along with other twist and lock type features are contemplated between the teeth 405 and the zipper tape is also contemplated. In each of these examples, the teeth 405 can snap into place on the zipper tape 405 to give the user a tactile indication that the teeth 405 are properly engaged with the zipper tape 405.

In another example, the teeth 405 can form several teeth sections and the teeth 405 can be placed onto the zipper tape 406 in several different sections. Each section can be configured to be replaceable should one or more of the teeth on a particular section become compromised. Each section can include one or more of threaded, interference fit-type, ball and socket-type, or bayonet-type of connection to the zipper tape 406 in accordance with the examples above.

Figure 6A:
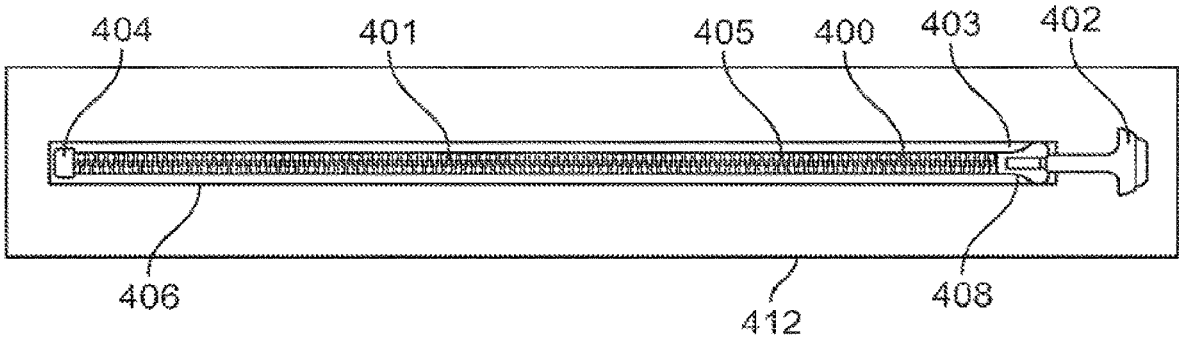
FIG. 6A shows a top view of an exemplary closure system device.
Figure 6B:
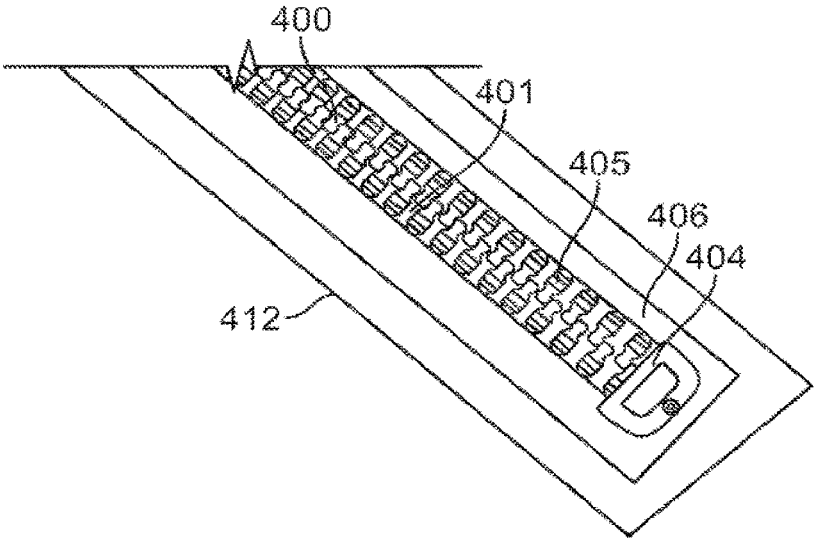
FIG. 6B shows a top view of an enlarged section of the exemplary closure system device of FIG. 4A.
Figure 6C:
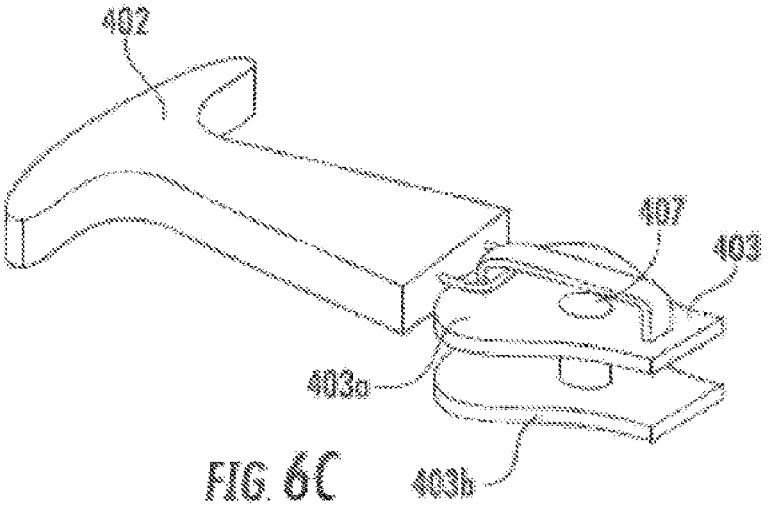
FIG. 6C shows a perspective view of an exemplary slider mechanism for an exemplary closure system.
Figure 6D:
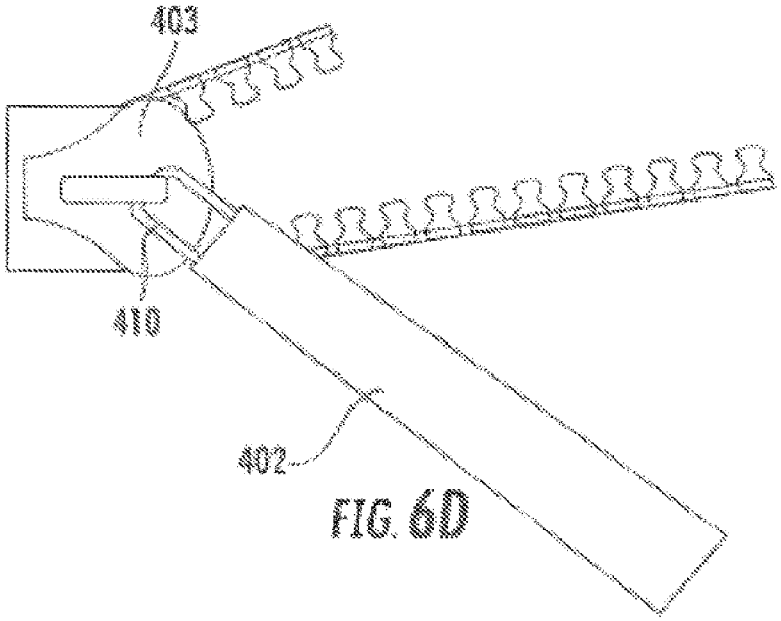
FIG. 6D shows a top view of another exemplary slider mechanism.

In addition to the zipper teeth, the slider body 403 can also be configured to be replaceable should the slider body 403 become damaged. The slider body 403 can be configured to connect to the zipper assembly in accordance with the examples provided above. As shown in FIG. 6C, in one specific example, the slider body 403 can include a first flange 403*a* and a second flange 403*b*. The flanges 403*a* and 403*b* can be held together with a removable fastener 407, or using the various fastening techniques described herein. To remove the slider body 403 from the zipper teeth 405, the removable fastener 407 can be removed or in the case of certain fastening techniques, the slider body 403 can be twisted such that the flanges 403*a* and 403*b* can be separated. This allows for the first flange 403*a* and the second flange 403*b* to disengage from the zipper and for the slider body 403 to be removed from the zipper. In this way, should the slider body 403 become damaged or if the slider body 403 needs to be replaced, the user can simply remove the fastener from the slider body 403 to replace the slider body with a new slider body.

In another example, the pull tab 402 can be configured to be replaceable should the pull tab become worn or damaged. In this example, the pull tab 402 can also be removably connected to the slider body 403. For example, the pull tab 402 can be connected to the slider body with any of the connections discussed herein. In addition, as shown in the example in FIG. 6D, the pull tab 402 could be connected to the slider body 403 by a spring clip 410 to hold the pull tab 402 in place on the slider body 403. The spring clip 410 can be removable such that the spring clip is biased into a slot located in a housing on the slider body 403 or the pull tab 402. In this way the pull tab 402 is removably fastened to the slider body 403. This allows the user to replace the pull tab 402 when it is needed or desired to replace the pull tab 402 on the slider body 403.

Additionally, the docking station 408 and the bottom stop 404 may also be configured to be removable for repairing purposes. In accordance with the above examples, the zipper docking station 408 and the bottom stop 404 can be secured to the zipper tape 406 by one or more of threads, interference fits, ball and socket connections, or bayonet-type connections, for example. In this way, if either the docking station 408 or the bottom stop 404 fail during use, the user can replace either component in using the removable fastening methods.

In another example, the entire zipper assembly 400 could be replaceable by a removable fastening method. Again, this could be accomplished by any of the removable connections discussed herein, e.g., threaded connections, interference fit-type connections, ball and socket connections, or bayonet-type type of connections. In one example, referring back to FIGS. 6A and 6B the zipper assembly could be configured to be removable at a seam 412 formed between the zipper tape 406 and an insulating device, for example.

Figure 7:
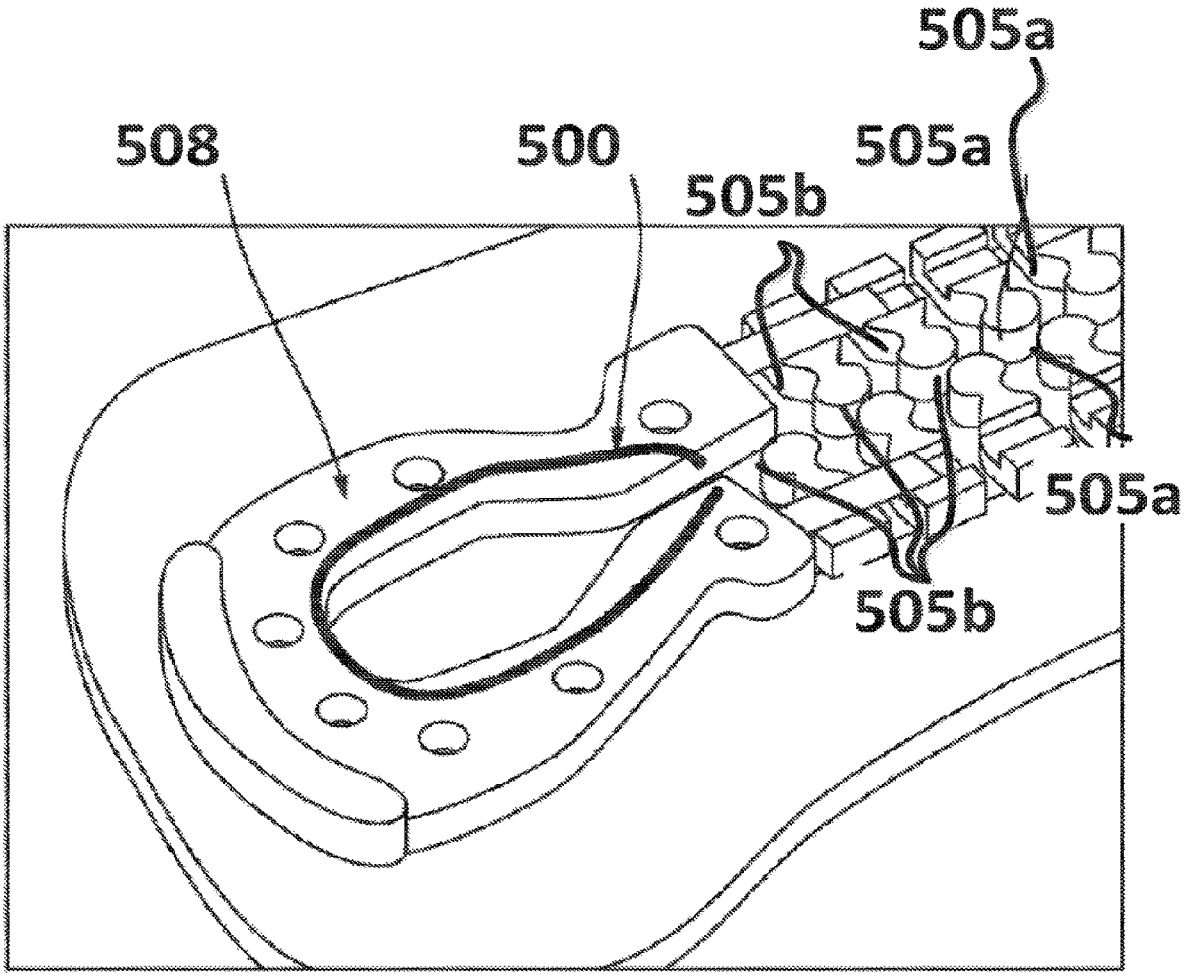
FIG. 7 illustrates another example closure system mechanism.

In other examples, the zipper assembly can be provided with various visual or audible indicators to indicate the user that the closure device is fully closed. In the example shown in FIG. 7, the zipper assembly 500 can be configured to indicate to the user when the zipper 501 is in the fully closed position. For example, the zipper assembly 500 can provide a visual or audible indication that the zipper is in the fully closed position. In one specific example, the docking station 508 of the zipper assembly 500 can be provided with a certain color such that when the zipper is fully engaged with the docking station, the color is no longer visible.

In another example, the zipper teeth 505 adjacent to the docking station 508 can be a first color and a second color such that when the zipper is fully engaged both colors are visible or only one color is visible to indicate that the zipper is in the fully closed position. In one specific example, a first set of teeth 505*a* can be provided with a first color and a second set of teeth 505*b* can be provided with a second color. In this example, the slider body can be configured to cover the second set of teeth 505*b* such that only the second color is visible. In one example, the first set of teeth can be formed green and the second set of teeth 505*b* can be formed red. However, any suitable colors are contemplated for the teeth. Alternatively, the slider can be configured to fully close the zipper such that both the first set of teeth 505*a* and the second set of teeth 505*b* are visible and the user sees both colors when the zipper is fully closed. Additionally, the first set of teeth 505*a* and the second set of teeth 505*b* can be formed of the same color such that the user sees one uniform color when the teeth are fully engaged.

In another example, the underside of the teeth can be provided with a color, such as red, so that when the zipper is fully closed, the user no longer sees red. In this way, the user knows that the zipper is fully closed when the color red, for example, is no longer visible. Alternatively, the zipper teeth could be extruded together such that when the zipper is in the open position a strip of color is exposed until the zipper teeth interlock and cover up example, a strip of color can be applied to the top surfaces of the teeth to indicate to the user that the zipper is fully closed. In another alternative example, the teeth could be formed translucent or transparent, such that an underlying strip of color could be visible through the teeth to indicate that the zipper is fully closed. In this example, the strip of color could be provided on a flap of fabric positioned underneath the zipper for insulation purposes.

Additionally, the slider body can be formed translucent or transparent such that the user can see when the zipper is fully closed and engaged with the docking station 508. In another example, the inside of the insulated cooler can be provided with a light, such as an LED, where the light stays illuminated until the zipper is fully closed. In this example, a switch can be wired such that when the zipper is fully closed, the light turns off. For example, the docking station 508 could include an electrical contact that is engaged by the slider body in order to turn the LED off to indicate to the user that the zipper is fully closed. In this way, the user knows when the zipper is fully closed.

In other examples, the zipper assembly 500 could be provided with a tactile feel to indicate to the user that the zipper is fully closed in conjunction with the above indicators. Also, in conjunction with the above visual indicators, the zipper could also be provided with an audible indicator such as a clicking type noise to indicate to the user that the zipper has been fully engaged and is in the closed position.

The present invention is disclosed above and in the accompanying drawings with reference to a variety of examples. The purpose served by the disclosure, however, is to provide examples of the various features and concepts related to the invention, not to limit the scope of the invention. One skilled in the relevant art will recognize that numerous variations and modifications may be made to the examples described above without departing from the scope of the present invention.

The invention claimed is:

1. A closure system comprising:

a first flange having a first end, a second end and a first engagement mechanism disposed between the first end and the second end;

a second flange having a first end, a second end and a second engagement mechanism disposed between the first end and the second end;

the first engagement mechanism configured to engage the second engagement mechanism, and the closure system having an open position wherein first engagement mechanism is substantially disengaged from the second engagement mechanism and a closed position wherein the first engagement mechanism is substantially engaged with the second engagement mechanism;

a slider configured to selectively engage the first engagement mechanism and the second mechanism when moved in a first direction and disengage the first engagement mechanism from the second engagement mechanism when moved in a second direction;

wherein the closure system is substantially watertight in the closed position;

wherein the first engagement mechanism comprises a plurality of rails and wherein each of the plurality of rails of the first flange extends from the first end of the first flange to the second end of the first flange;

wherein the second engagement mechanism comprises a plurality of rails and wherein each of the plurality of rails of the second flange extends from the first end of the second flange to the second end of the second flange;

wherein each of the plurality of rails of the first flange further comprises a barb extending from an edge of each of the plurality of rails; and wherein each of the plurality of rails of the second flange further comprises a barb extending from an edge of each of the plurality of rails;

wherein the closure system us configured to bias open; and wherein the closure system is configured to open to an angle of at least 45 degrees and remain in an open position.

2. The closure system of claim 1, wherein the closure system is watertight up to 7 psi above atmospheric pressure.

3. The closure system of claim 1, wherein the closure system is watertight up to 2 psi to 14 psi above atmospheric pressure.

4. The closure system of claim 1, wherein each of the first end and the second end of the closure system comprise a flexible material.

5. The closure system of claim 1, further comprising at least one resilient member engaged with the first flange and the second flange, wherein the at least one resilient member is configured to bias the closure system open.

6. The closure system of claim 1, wherein each of the first engagement mechanism and the second engagement mechanism comprise a flexible material.

7. The closure system of claim 1, wherein each of the first engagement mechanism and the second engagement mechanism include a hollow portion.

8. The closure system of claim 7, wherein the hollow portion of each of the first engagement mechanism and the second engagement mechanism is a vacuum.

9. The closure system of claim 1, wherein one or more parts of the first engagement mechanism is configured to removably engage the first flange with at least one of: press fitting, snap fit mechanisms or mechanical fasteners, and wherein one or more parts of the second engagement mechanism is configured to removably engage the second flange with at least one of: press fitting, snap fit mechanisms or mechanical fasteners.

10. The closure system of claim 1, wherein the slider is configured to removably engage the first and second flange with at least one of: press fitting, snap fit mechanisms or mechanical fasteners.

11. The closure system of claim 1, further comprising a closure indicator configured to indicate the closure system is in a fully closed position.

12. A closure system comprising:

a first flange having a first end, a second end and a first engagement mechanism disposed between the first end and the second end;

a second flange having a first end, a second end and a second engagement mechanism disposed between the first end and the second end;

the first engagement mechanism configured to engage the second engagement mechanism, and the closure system having an open position wherein first engagement mechanism is substantially disengaged from the second engagement mechanism and a closed position wherein the first engagement mechanism is substantially engaged with the second engagement mechanism;

a slider configured to selectively engage the first engagement mechanism and the second mechanism when moved in a first direction and disengage the first engagement mechanism from the second engagement mechanism when moved in a second direction;

wherein the closure system is substantially watertight in the closed position;

wherein the first engagement mechanism comprises a plurality of rails and wherein each of the plurality of rails of the first flange extends from the first end of the first flange to the second end of the first flange;

wherein the second engagement mechanism comprises a plurality of rails and wherein each of the plurality of rails of the second flange extends from the first end of the second flange to the second end of the second flange;

wherein each of the plurality of rails of the first flange further comprise a barb extending from an edge of each of the plurality of rails; and wherein each of the plurality of rails of the second flange further comprise a barb extending from an edge of each of the plurality of rails;

wherein the closure system us configured to bias open; and wherein the closure system is configured to open to an angle of at least 45 degrees and remain in an open position.

13. The closure system of claim 12, wherein each of the first end and the second end of the closure system comprise a flexible material.

14. The closure system of claim 12, wherein each of the first engagement mechanism and the second engagement mechanism comprise a flexible material.

15. The closure system of claim 12, wherein each of the first engagement mechanism and the second engagement mechanism include a hollow portion.

16. The closure system of claim 12, wherein one or more parts of the first engagement mechanism is configured to removably engage the first flange with at least one of: press fitting, snap fit mechanisms or mechanical fasteners, and wherein one or more parts of the second engagement mechanism is configured to removably engage the second flange with at least one of: press fitting, snap fit mechanisms or mechanical fasteners.

17. The closure system of claim 12, wherein the slider is configured to removably engage the first and second flange with at least one of: press fitting, snap fit mechanisms or mechanical fasteners.

18. The closure system of claim 1, wherein the first flange and the second flange are formed with microspheres to increase the insulative properties of the closure system.

19. The closure system of claim 1, wherein the first flange and the second flange are formed with vacuum insulated micro-spheres to increase the insulative properties of the closure system.

20. The closure system of claim 12, wherein the first flange and the second flange are formed with microspheres to increase the insulative properties of the closure system.

21. The closure system of claim 12, wherein the first flange and the second flange are formed with vacuum insulated micro-spheres to increase the insulative properties of the closure system.

* * * * *